US011312592B2

(12) United States Patent
Iwata

(10) Patent No.: US 11,312,592 B2
(45) Date of Patent: Apr. 26, 2022

(54) SHEET STACKING APPARATUS AND IMAGE FORMING APPARATUS

(71) Applicant: Toshiyuki Iwata, Yamanashi-ken (JP)

(72) Inventor: Toshiyuki Iwata, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 202 days.

(21) Appl. No.: 16/698,034

(22) Filed: Nov. 27, 2019

(65) Prior Publication Data

US 2020/0207568 A1 Jul. 2, 2020

(30) Foreign Application Priority Data

Dec. 28, 2018 (JP) ..... JP2018-247123

(51) Int. Cl.
*B65H 31/34* (2006.01)
*B65H 31/10* (2006.01)

(52) U.S. Cl.
CPC ..... *B65H 31/34* (2013.01); *B65H 31/10* (2013.01)

(58) Field of Classification Search
CPC ..... B65H 31/34; B65H 31/10; B65H 2405/11425
See application file for complete search history.

(56) References Cited

U.S. PATENT DOCUMENTS

2013/0026703 A1* 1/2013 Watanabe ..... B65H 31/10 271/220
2013/0285312 A1* 10/2013 Tokuma ..... B65H 31/34 271/220
2013/0285313 A1* 10/2013 Iwata ..... G03G 15/6538 271/220
2015/0014916 A1* 1/2015 Saito ..... B65H 31/34 271/185

FOREIGN PATENT DOCUMENTS

JP 2013-230891 A 11/2013

* cited by examiner

*Primary Examiner* — Howard J Sanders
(74) *Attorney, Agent, or Firm* — Manabu Kanesaka

(57) ABSTRACT

Provided is a sheet stacking apparatus including an aligning member lifting-lowering device configured to lift and lower aligning members between an aligning position where the aligning members abut to and align the sheets and a retreating position where the aligning members are lifted from an upper surface of the sheets, an aligning member moving device configured to move the aligning members in a sheet width direction, and a stack tray lifting-lowering device configured to lift and lower a stack tray based on a detection result of a sheet surface detecting device. A controller lifts the aligning members to the retreating position with the aligning member lifting-lowering device after the sheets stacked on the stack tray is aligned at the aligning position, and stops lifting-lowering operation of the stack tray lifting-lowering device while the aligning members are moved in the sheet width direction with the aligning member moving device.

8 Claims, 19 Drawing Sheets

SHEET STACKING APPARATUS AND IMAGE FORMING APPARATUS

CROSS-REFERENCE TO RELATED APPLICATION

The present application is based on and claims priority of Japanese Patent Application No. 2018-247123 filed on Dec. 28, 2018, the disclosure of which is incorporated herein.

TECHNICAL FIELD

The present invention relates to a sheet stacking apparatus which aligns sheets in a sheet width direction and stacks the sheets on a stack tray and an image forming apparatus.

BACKGROUND ART

Conventionally, there has been known a sheet stacking apparatus capable of aligning sheets discharged onto a stack tray in a sheet width direction intersecting with a sheet discharging direction after forming an image by an image forming apparatus or the like (e.g., Japanese Unexamined Patent Application Publication No. 2013-230891). As illustrated in FIGS. 20A to 20D, the sheet stacking apparatus disclosed in Japanese Unexamined Patent Application Publication No. 2013-230891 includes a pair of aligning members 1519 movable in the width direction above a single or a plurality of stack trays 1515. The sheet stacking apparatus moves aligning members 1519*a*, 1519*b* in the sheet width direction when sheets are discharged onto the stack tray 1515, and aligns the sheets by abutting the aligning members 1591*a*, 1519*b* to both ends of the sheets in the width direction. In an apparatus performing sorting processing on sheets at the time of aligning the sheets in the width direction as the above, alignment in the width direction is performed by fixing one aligning member 1519*a* as a reference side for alignment and moving the other aligning member 1519*b* in the width direction so that the sheets abut to the aligning member 1519*a*. When a position of the aligning members 1519 for the sorting processing is changed after performing the sorting processing, to switch the reference side for alignment, the aligning members 1519 are retreated upward from an aligning position of the sheets and move to a reception position for subsequent sheets in the sheet width direction in that state. Such an apparatus prevents contact of the aligning members 1519 with stacked sheets during moving by moving the aligning members 1519 after once retreating upward.

The stack tray 1515 is arranged capable of being lifted and lowered, and generally, the stack tray 1515 is lowered as the number of stacked sheets increase. A sheet detecting device is arranged for detecting height of an uppermost surface sheet in the vicinity of a sheet discharge port. By continuously monitoring the height of the stacked sheet surface by the sheet detecting device and repeating lifting and lowering of the stack tray 1515 in accordance therewith, subsequent sheets can be received at an optimum height position.

SUMMARY OF THE INVENTION

However, as illustrated in FIG. 20, for example, when an end of a sheet to be stacked on the stack tray 1515 is curled upward, the curled part is detected by a sheet surface detecting sensor S9 arranged at the stack tray 1515, the sheet surface is determined to be high, and the stack tray 1515 is lowered from a position of FIG. 20A to a position of FIG. 20B. When the stack tray 1515 is lowered as the above, an optical axis of the sheet surface detecting sensor S9 appears, and now the stack tray 1515 is lifted. When the stack tray 1515 is lifted, as illustrated in FIG. 20C, the curl at a rear end side of the sheet is resolved and the stack tray 1515 is lifted to a position higher than the position before being lowered. Here, there is a fear that the aligning members 1519 contact to the uppermost sheet surface already stacked when moving the aligning members 1519 in the sheet width direction even though having been retreated from the aligning position in the height direction. When the aligning members 1519 are moved in the sheet width direction at the timing of lifting the stack tray 1515, as illustrated in FIG. 20D, the stack tray 1515 is lifted in accordance with height of the curled part. Due to the lifting of the stack tray 1515, there is a fear that the aligning members 1519 contact to the sheets, so that misalignment occurs on sheets stacked on the stack tray 1515 and already aligned in association with moving operation of the aligning members 1519 and alignment of the stacked sheets is spoiled.

The object of the present invention is to provide a sheet stacking apparatus and an image forming apparatus capable of performing sorting processing on sheets with fine alignment even when a part of sheets stacked on a stack tray is curled.

To solve the abovementioned problems, a sheet stacking apparatus of the present invention includes a conveyance device configured to convey sheets in a predetermined sheet conveyance direction, a stack tray on which sheets conveyed by the conveyance device are to be stacked, a pair of aligning members configured to abut to the sheet stacked on the stack tray in a sheet width direction intersecting with the sheet conveyance direction and to align the sheet, an aligning member lifting-lowering device configured to lift and lower the aligning members between an aligning position where the aligning members abut to and align the sheet and a retreating position where the aligning members are lifted from an upper surface of the sheet, an aligning member moving device configured to move the aligning members in the width direction, a sheet surface detecting device configured to detect an uppermost surface position of the sheets stacked on the stack tray, a stack tray lifting-lowering device configured to lift and lower the stack tray based on a detection result of the sheet surface detecting device, and a controller configured to control the aligning member lifting-lowering device, the aligning member moving device, and the stack tray lifting-lowering device. Here, the controller lifts the aligning members to the retreating position with the aligning member lifting-lowering device after the sheets stacked on the stack tray is aligned at the aligning position, and stops lifting-lowering operation of the stack tray lifting-lowering device while the aligning members are moved in the sheet width direction with the aligning member moving device.

According to a sheet stacking apparatus of the present invention, a sheet conveyed to a stack tray later can be aligned without occurrence of contact with sorting processed sheets aligned on the stack tray, so that continuous sorting processing can be performed smoothly and certainly.

EMBODIMENTS OF THE INVENTION

In the following, a sheet stacking apparatus and an image forming apparatus including the sheet stacking apparatus of the present invention will be described based on FIGS. 1 to 19. Here, structural elements described in the following embodiments are only illustrative and the scope of claims of the present invention is not limited to the structural elements.

Figure 1:
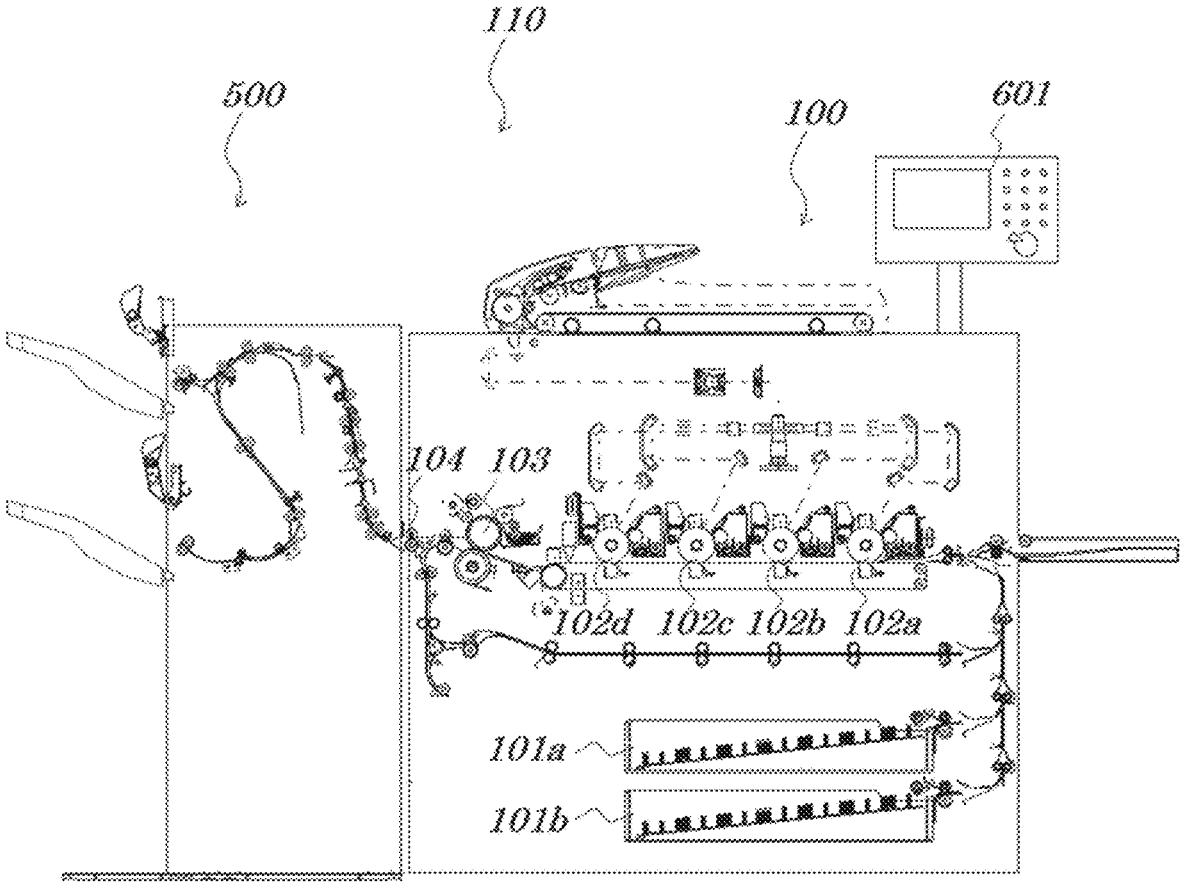
FIG. 1 is a sectional view of a sheet stacking apparatus and an image forming apparatus of the present invention.

As illustrated in FIG. 1, an image forming apparatus 110 is configured of an apparatus main body 100 and a sheet stacking apparatus 500 connected to the apparatus main body 100. A toner image of four colors is transferred by photosensitive drums 102*a* to 102*d* of yellow, magenta, cyan, black, or the like respectively as an image forming device to a sheet fed from a cassette 101*a*, 101*b* in the apparatus main body 100, the sheet is conveyed to a fixing device 103 so that the toner image is fixed, and then, the sheet is discharged from the apparatus main body 100 to the sheet stacking apparatus 500 by a sheet discharge roller 104.

Figure 2:
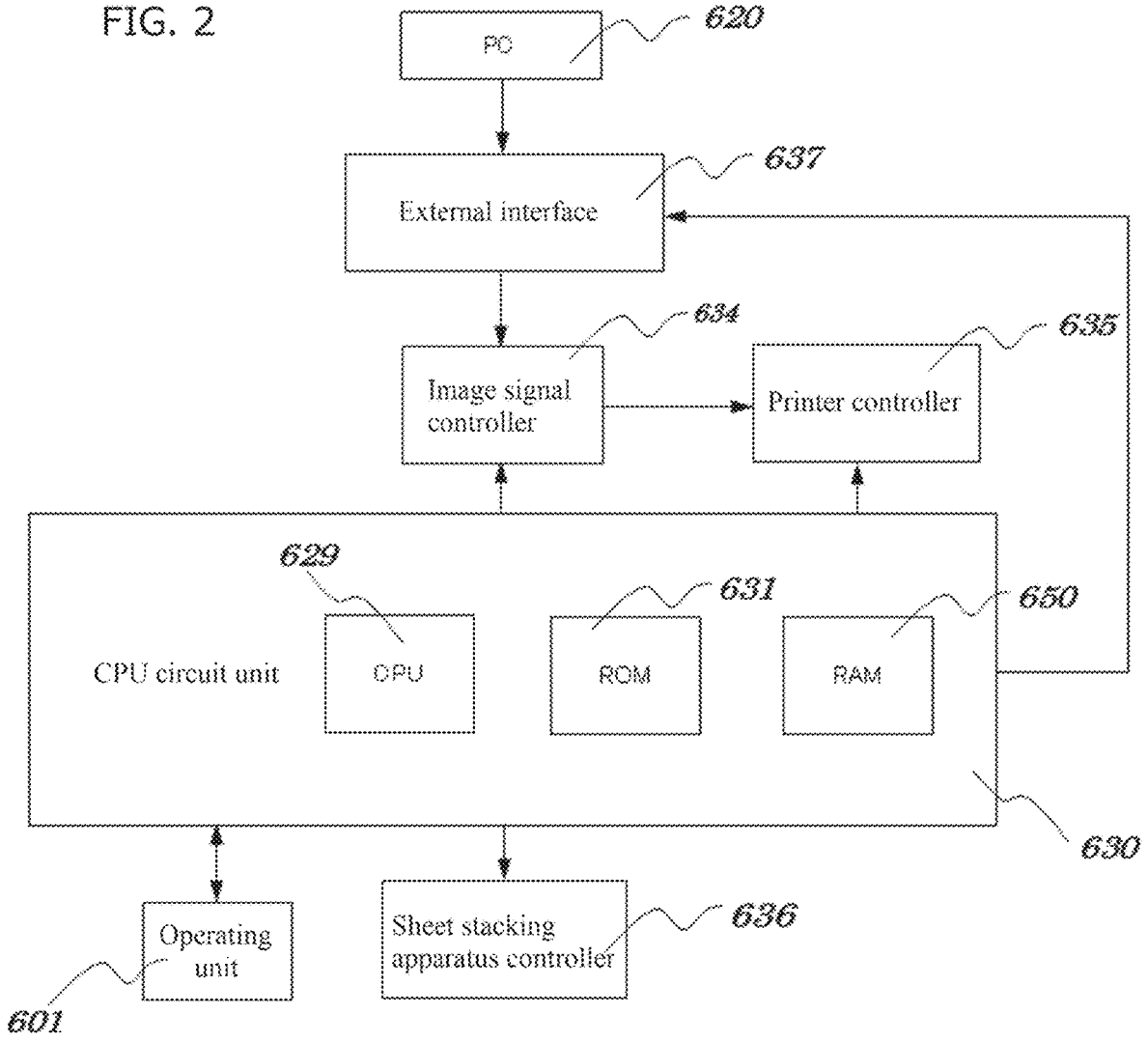
FIG. 2 is a block diagram illustrating the configuration of the image forming apparatus.

FIG. 2 is a block diagram of an apparatus controller which controls the image forming apparatus 110. A CPU circuit unit 630 includes a CPU 629, a ROM 631, and a RAM 650. The CPU circuit unit 630 controls an image signal controller 634, a printer controller 635, a sheet stacking apparatus controller 636, and an external interface 637. The CPU circuit unit 630 performs control in accordance with a program stored in the ROM 631 and setting from an operating unit 601. The printer controller 635 controls the apparatus main body 100 and the sheet stacking apparatus controller 636 controls the sheet stacking apparatus 500. The RAM 650 is used as an area to temporarily hold control data and a working area for calculation associated with the control. The external interface 637 is an interface for an external computer (PC) 620. Signals are exchanged in two-way between the PC 620 and the CPU circuit unit 630 via the external interface 637. Print data is transmitted from the PC 620 to the image signal controller 634 via the external interface 637. The image signal controller 634 develops the transmitted print data into an image and outputs an image signal to the printer controller 635. Then, the image signal output from the image signal controller 634 to the printer controller 635 is input to an image forming device illustrated in FIG. 1.

Figure 3:
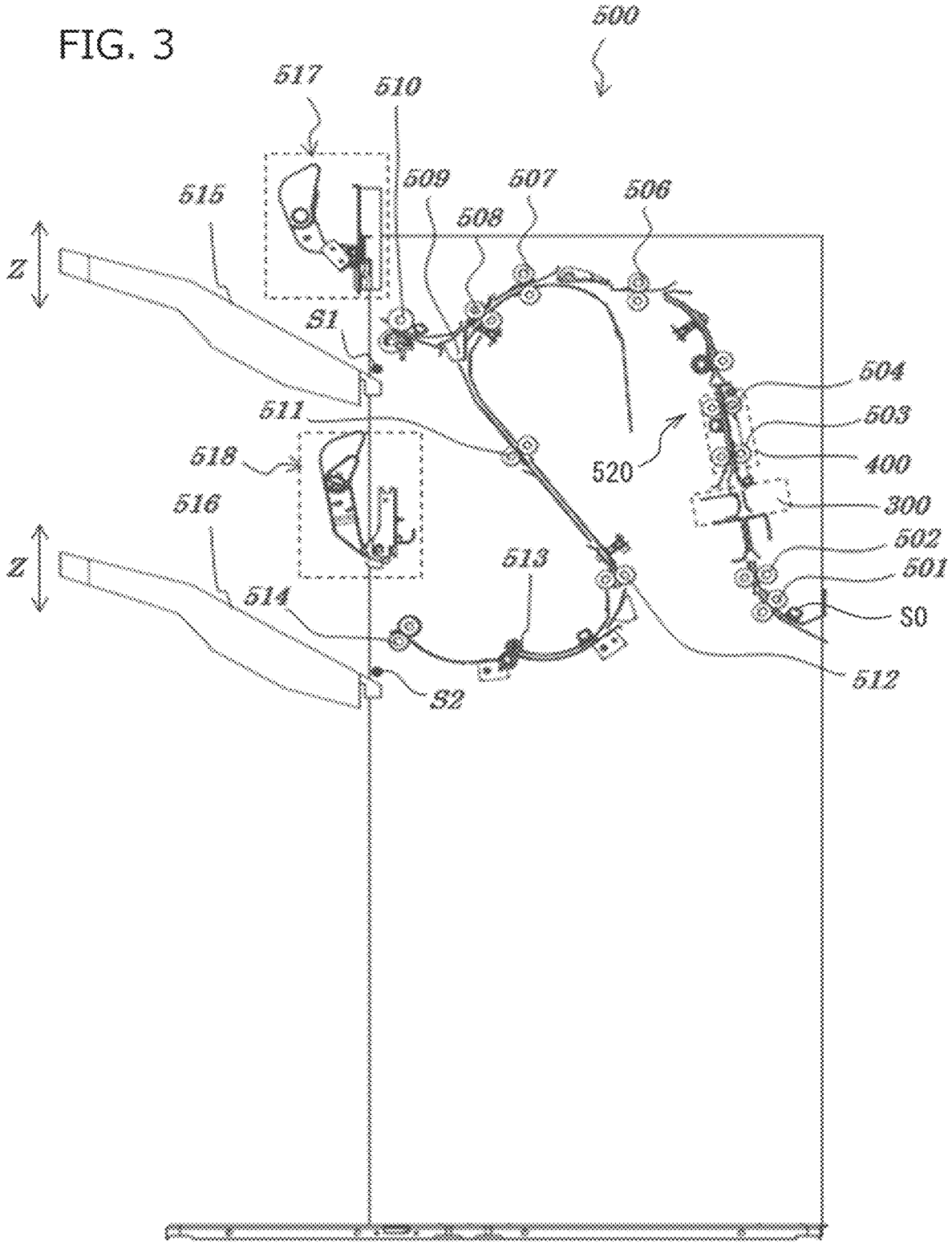
FIG. 3 is a sectional view of the sheet stacking apparatus.

Next, the sheet stacking apparatus 500 will be described in detail. As illustrated in FIG. 1, a sheet discharged from the apparatus main body 100 are fed to the sheet stacking apparatus 500. As illustrated in FIG. 3, the sheet stacking apparatus 500 includes a sheet conveyance path 520 extending from an upstream side to a downstream side in a sheet conveyance direction, a sheet detecting device (inlet sensor) S0, arranged at the upstream side of the sheet conveyance path 520, which detects that a sheet is conveyed from the apparatus main body 100, and an inlet roller 501 which guides a sheet having passed through the inlet sensor S0 to the downstream side. A sheet received at the inlet roller 501 is sequentially conveyed to an inlet conveyance roller pair 502, conveyance devices (shift conveyance roller pairs) 503, 504 arranged in a shift unit 400, and a discharge conveyance roller pairs 506 to 508, and then, stacked on one of a first stack tray 515 and a second stack tray 516. The sheet stacking apparatus 500 has a sorting processing function in which a sheet can be stacked being shifted in a predetermined width in a direction intersecting with the sheet conveyance direction, when sheets are discharged to the first stack tray 515 and the second stack tray 516, so that sheets can be easily sorted. The sorting processing function is executed by the shift device (shift unit) 400 arranged at the sheet conveyance path 520 extending from the sheet discharge roller 104 side (upstream side) of the apparatus main body 100 toward the first stack tray 515 and the second stack tray 516 (downstream side). In the present embodiment, the sheet stacking apparatus 500 is configured to be attachable to the image forming apparatus 110 as an option. However, the sheet stacking apparatus 500 may be configured to be incorporated in the image forming apparatus 110. Further, the stack trays are in a two stage structure of the first and the second. However, the number of stages is not limited and the structure may be one stage or three or more stages.

The lateral registration detecting unit 300 is arranged at the upstream side of the shift unit 400. The lateral registration detecting unit 300 is activated when a user selects sorting processing with the operating unit 601, so that a position of a sheet on which sorting processing is to be performed by the shift unit 400 in a direction intersecting with the conveyance direction (hereinafter referred to as a sheet width direction) is detected. When the position of a sheet in the sheet width direction is detected by the lateral registration detecting unit 300, the shift unit 400 moves in a direction intersecting with the sheet conveyance direction based on the detection result.

Then, with a switching flapper 509 arranged at the downstream side, a sheet fed to the discharge conveyance roller pair 508 is stacked onto the first stack tray 515 from a discharge roller pair 510 or stacked onto the second stack tray 516 via a discharge conveyance roller pair 514 after being conveyed through conveyance roller pairs 511 to 513. Switching of the switching flapper 509 is performed by turning on or off an unillustrated solenoid. A sheet stacked on the first stack tray 515 are aligned in the sheet width direction by a first aligning portion 517. A sheet stacked on the second stack tray 516 are aligned in the sheet width direction by a second aligning portion 518.

The sheet stacking apparatus 500 includes a first sheet surface detecting sensor S1 and a second sheet surface detecting sensor S2 as a detecting device to detect an uppermost surface of sheets stacked on the first stack tray 515 and the second stack tray 516, respectively. The first stack tray 515 and the second stack tray 516 are lifted and lowered in the arrowed Z direction based on the detection results of the first sheet surface detecting sensor S1 and the second sheet surface detecting sensor S2, respectively. Thus, each of the uppermost surfaces of the sheets stacked on the first stack tray 515 and the second stack tray 516 can be kept constant.

Operation of detecting the sheet surface is as follows. The first stack tray 515 or the second stack tray 516 is lifted from below, and a state that an optical axis of the first sheet surface detecting sensor S1 or the second sheet surface detecting sensor S2 is blocked by sheets stacked on the first or second stack trays 515, 516 or an upper surface of the first or second stack trays 515, 516 is set as a home position (HP). The first or second stack tray 515, 516 is lowered until the optical axis of the first sheet surface detecting sensor S1 or the second sheet surface detecting sensor S2 appears, and then, is lifted until the optical axis is blocked again. The above operation is repeated. For example, in a case that sheets are curled upward, the first or second sheet surface detecting sensor S1 or S2 detects the curled part of the sheets and determines that the uppermost surface of the sheets is high. Therefore, the first or second stack tray 515, 516 is lowered until the optical axis of the first or second sheet surface detecting sensor S1, S2 appears, and then, is lifted until the optical axis is blocked again. Since the upward curling of the stacked sheets is resolved due to the lifting operation, the first or second stack tray 515, 516 can be lifted to provide an appropriate sheet surface height and sheet alignment of the sheets can be performed without engagement failure of a later described aligning member 519.

Figure 4:
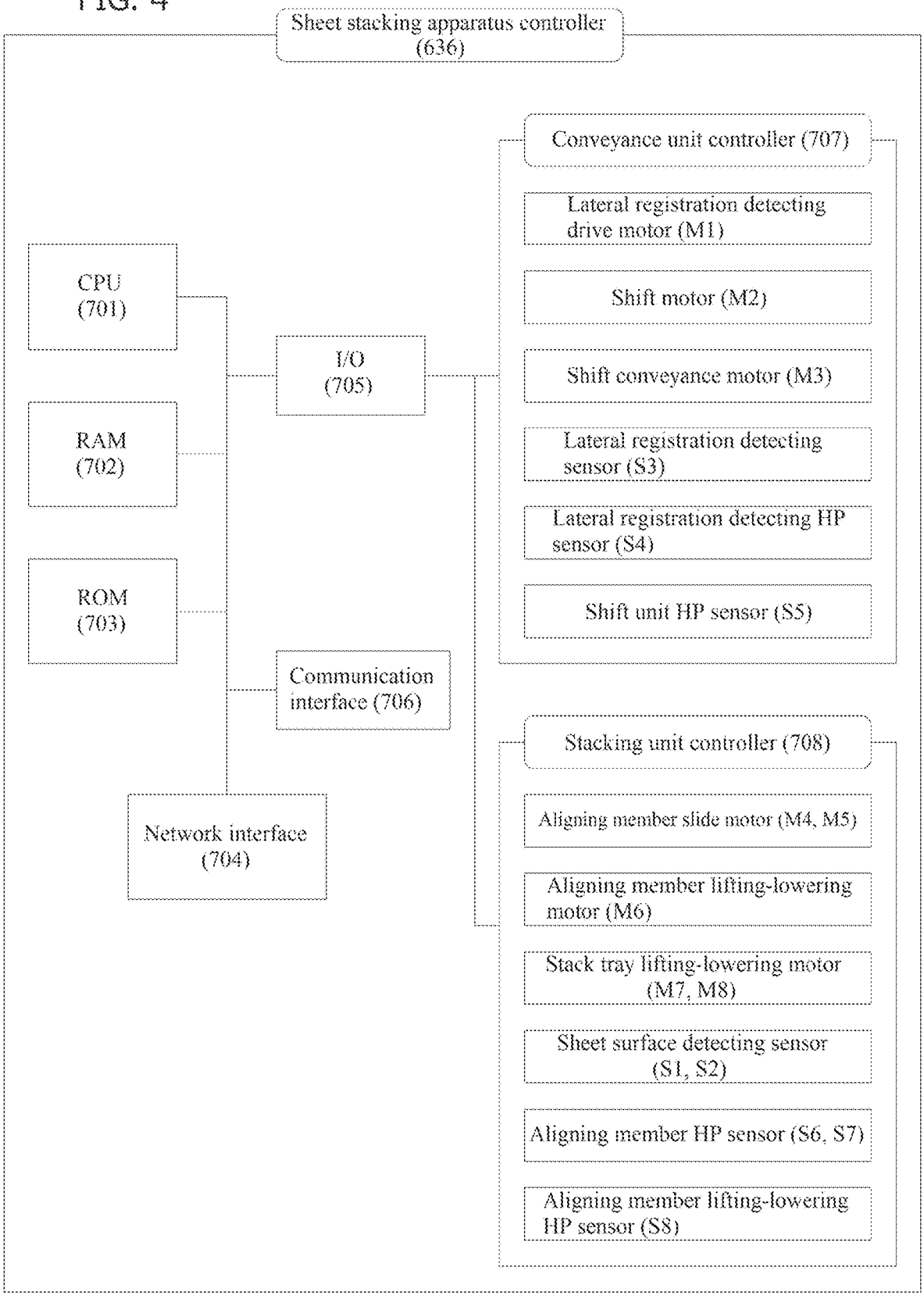
FIG. 4 is a block diagram illustrating the configuration of the sheet stacking apparatus.

Next, the sheet stacking apparatus controller 636 which controls the sheet stacking apparatus 500 will be described based on FIG. 4. FIG. 4 illustrates an example of a controller configuration but not limited thereto. The sheet stacking apparatus controller 636 may be integrally arranged in the apparatus main body 100 together with the CPU circuit unit 630 and the sheet stacking apparatus 500 may be controlled from the apparatus main body 100 side.

The sheet stacking apparatus controller 636 is configured of a CPU 101, a RAM 702, a ROM 703, an I/O 705, a network interface 704, a communication interface 706, and the like. The I/O 705 controls a conveyance unit controller 707 and a stacking unit controller 708. The conveyance unit controller 707 includes a lateral registration detecting drive motor M1, a shift motor M2 for moving the shift unit 400, a shift conveyance motor M3 for conveying a sheet in the shift unit 400, a lateral registration detecting sensor S3, a lateral registration detecting HP sensor S4, and a shift unit HP sensor S5. The stacking unit controller 708 includes front-back aligning member slide motors M4, M5 which are aligning member moving devices, an aligning member lifting-lowering motor M6 which is an aligning member lifting-lowering unit, first and second stack tray lifting-lowering motors M7, M8 which are stack tray lifting-lowering devices, first and second sheet surface detecting sensors S1, S2, front-back aligning member HP sensors S6, S7, and an aligning member lifting-lowering HP sensor S8. Each of the sensors S1 to S8 detect a position as a reference and the motors M1 to M8 are controlled based on the detection results.

Figure 5:
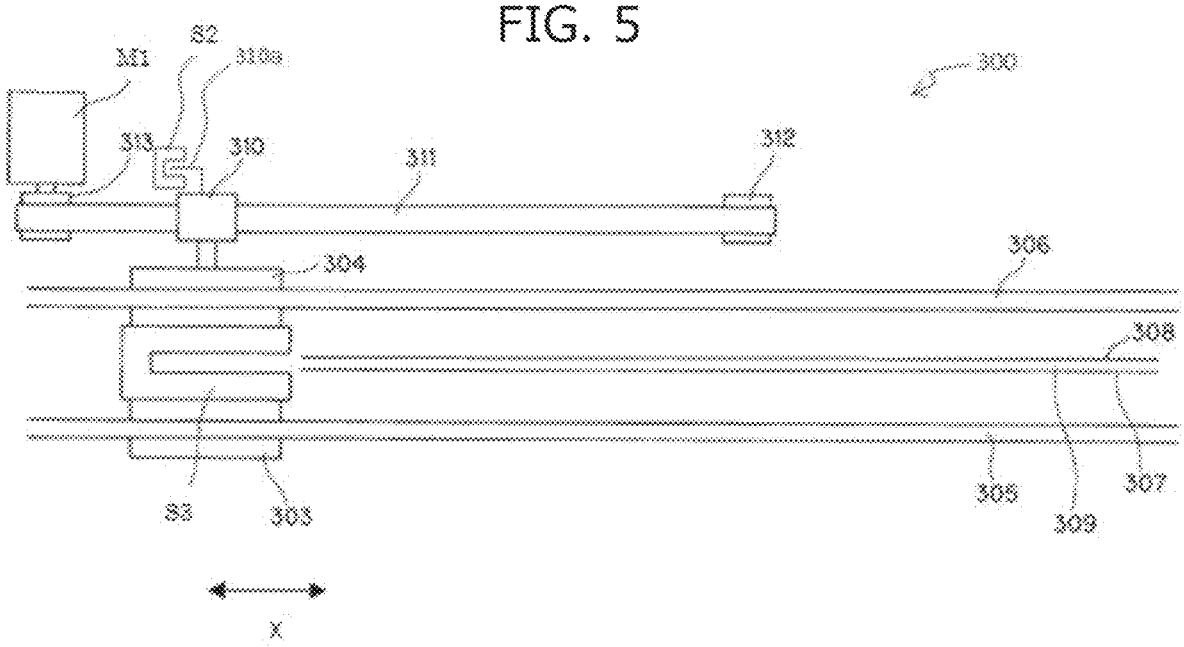
FIG. 5 is a diagram viewing a lateral registration detecting unit from a downstream side of a sheet conveyance direction.

Next, the lateral registration detecting unit 300 will be described in detail based on FIG. 5. FIG. 5 is a diagram viewing the lateral registration detecting unit 300 from the downstream side of the sheet conveyance direction. At the lateral registration detecting unit 300, an end part of a sheet in the sheet width direction is detected by the lateral registration detecting sensor S3 when the sheet passes through a conveyance path 309 configured of a pair of conveyance guides 307, 308, so that a position of the sheet in the sheet width direction is determined. The lateral registration detecting sensor S3 includes bearings 303, 304. Each of the bearings 303, 304 are configured movable in an arrowed X direction along guides 305, 306 fixed to the sheet stacking apparatus 500. The lateral registration detecting sensor S3 is previously moved to a position corresponding to a sheet size, information of the sheet size being input from the operating unit 601 of the apparatus main body 100. The lateral registration detecting sensor S3 has a recess and detects an end part, in the sheet width direction, of a sheet entering the recess. A driving source for moving the lateral registration detecting sensor S3 is the lateral registration detecting drive motor M1. Then, a timing belt 311 is operated with a pulley 313 arranged at the lateral registration detecting drive motor M1 and a pulley 312 fixed to the sheet stacking apparatus 500. The lateral registration detecting sensor S3 and the timing belt 311 are connected to each other via a fixed plate 310 and the lateral registration detecting sensor S3 can be moved in association with the operation of the timing belt 311. At this time, the home position (HP) of the lateral registration detecting sensor S3 is determined by detecting a fixed plate flag portion 310*a* arranged at the fixed plate 310 by a lateral registration detecting HP sensor S4 attached to the sheet stacking apparatus 500, the lateral registration detecting drive motor M1 is driven from the home position (HP) by predetermined pulses, and the lateral registration detecting sensor S3 is moved from the home position (HP) to a position corresponding to the sheet size.

Figure 6:
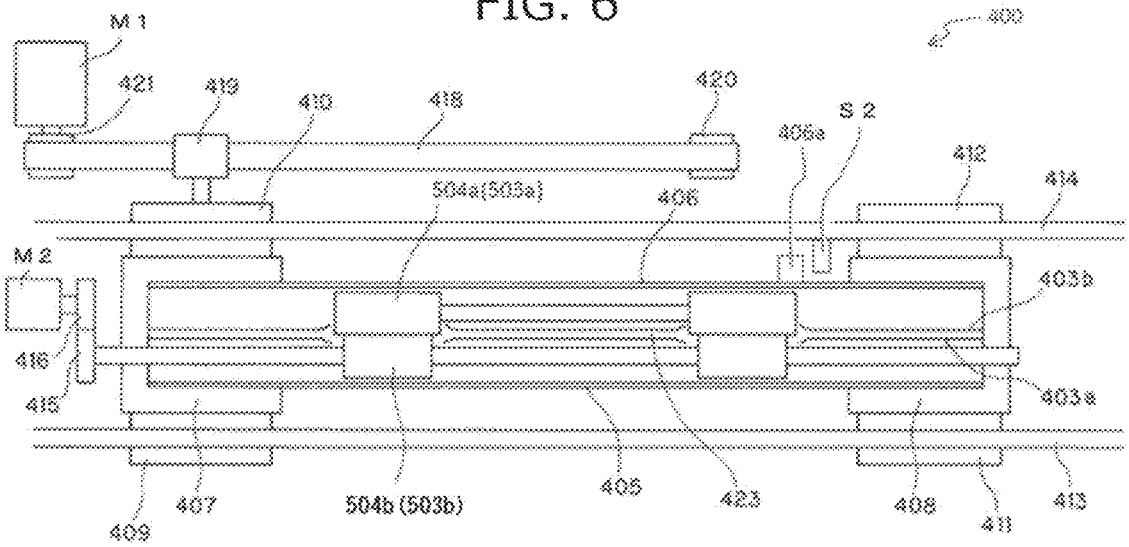
FIG. 6 is a diagram viewing a shift unit from the downstream side of the sheet conveyance direction.

FIG. 6 is a diagram viewing the shift unit 400 from the downstream side of the sheet conveyance direction. In the shift unit 400, a conveyance path 423 is configured of conveying guides 403*a*, 403*b*. The conveyance path 423 is configured capable of sandwiching and conveying a sheet with shift conveyance rollers 503*a*, 503*b*, 504*a*, 504*b* (see FIG. 3). The shift conveyance roller pairs 503, 504 are connected to the shift conveyance motor M3 via gears 415, 416 and are configured capable of rotating forward and backward in accordance with rotation of the shift conveyance motor M3. The shift conveyance roller pairs 503, 504 and conveyance guides 403*a*, 403*b* are supported by frames 405, 406, 407, 408. Bearings 409, 410, 411, 412 fixed to the frames 405, 406, 407, 408 are configured movable along guides 413, 414. The frames 405, 406, 407, 408 are connected to a timing belt 418 via a fixed plate 419. The fixed plate 419 is configured movable with the shift motor M2 and pulleys 420, 421 via the timing belt 418. Thus, a sheet can be moved in the direction intersecting with the sheet conveyance direction while conveying the sheet in the sheet conveyance direction with the shift conveyance roller pairs 503, 504. Sheets stacked onto the first and second stack trays 515, 516 can be sorted by changing the moving direction of the shift unit 400. The home position of the shift unit 400 is determined by detecting a flag portion 406*a* in the frame 406 by the shift unit HP sensor S5 attached to the sheet stacking apparatus 500.

Next, operation of the first aligning portion 517 and the second aligning portion 518 for aligning sheets stacked on the first and second stack trays 515, 516 will be described. Here, since the first aligning portion 517 and the second aligning portion 518 have the same configuration, the first aligning portion 517 will be described and description of the second aligning portion 518 will be omitted.

Figure 7A:
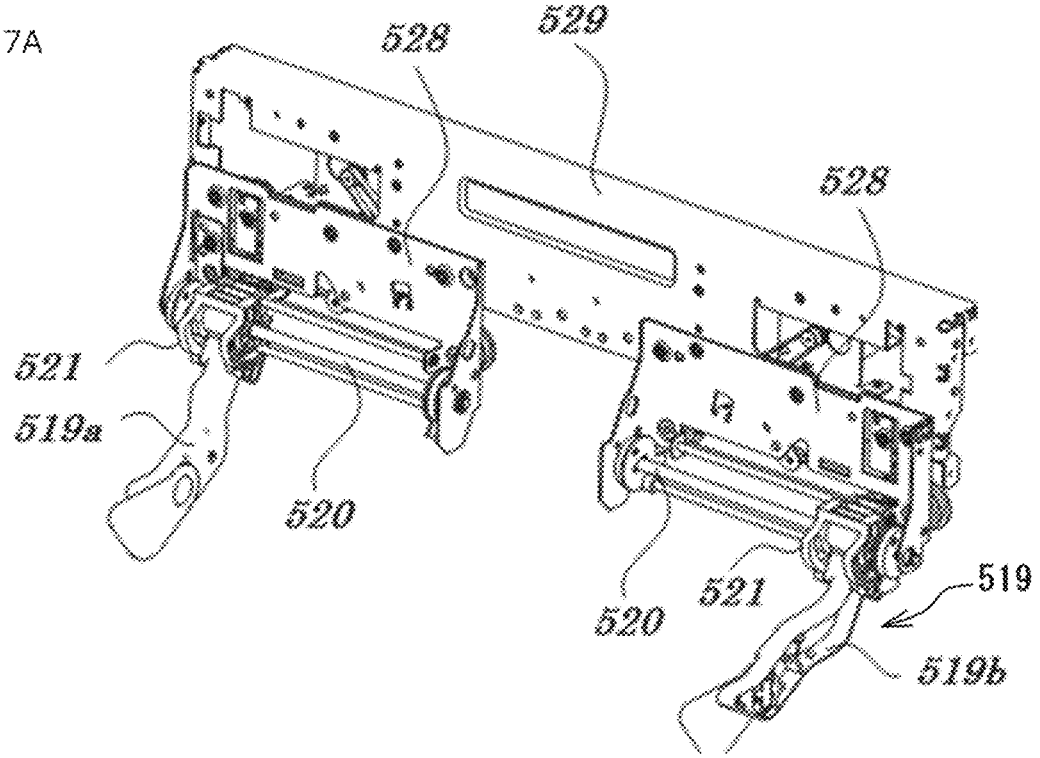
FIGS. 7A and 7B are perspective views of an aligning member.
Figure 7B:
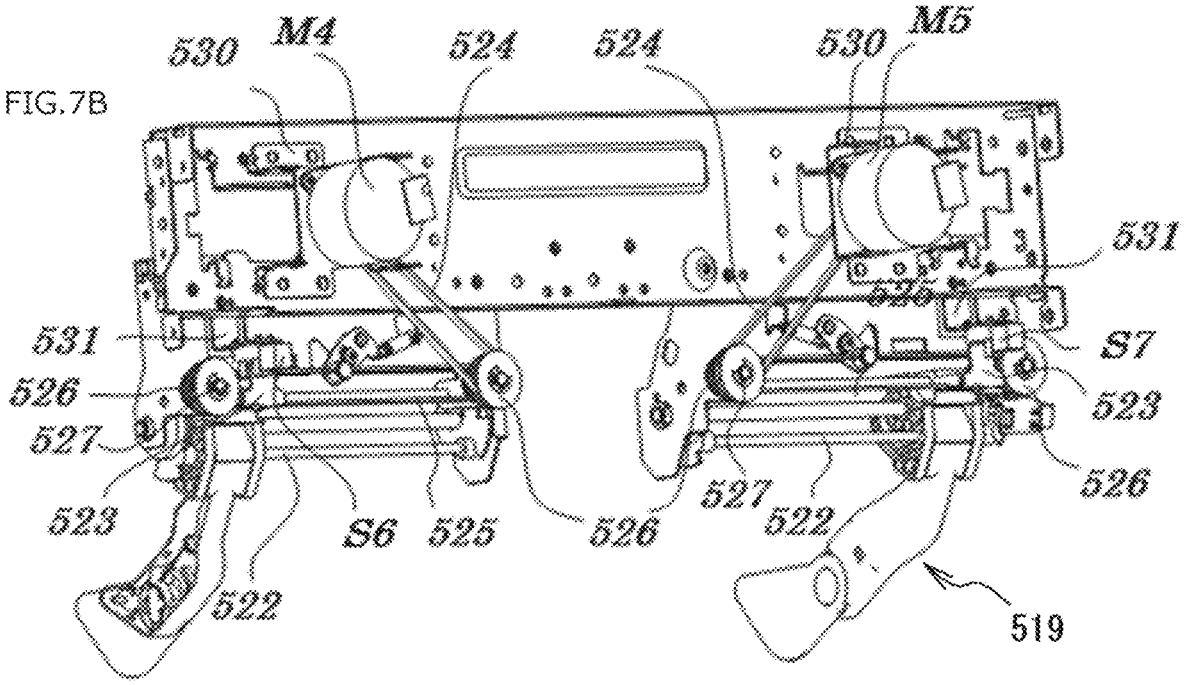

First, sliding operation in the front-back direction which is basic operation of the aligning member 519 and configuration members of a slide portion will be described based on FIGS. 7A and 7B. In the following, viewing the sheet stacking apparatus 500 from the direction illustrated in FIG. 3, the near side in the depth direction is referred to as front and the far side is referred to as back. As illustrated in FIG. 7A, the aligning member 519 is supported with a first aligning supporting shaft 520. The outer side of the aligning member 519 is guided by a slide member 521 and follows front-back movement of the slide member 521. The slide member 521 is supported by the first aligning supporting shaft 520 as a rotation center, similarly to the aligning member 519, and a second aligning supporting shaft 522 as a rotation stopper. The slide member 521 and a slide position detecting member 523 sandwich a second slide drive transmission belt 525 therebetween, and these three components are combined with screws. Both ends of the second slide drive transmission belt 525 are supported by a slide drive transmission pulley 526. The slide drive transmission pulley 526 is a stepped pulley and is engaged with a first slide drive transmission belt 524. The first slide drive transmission belt 524 is engaged with a pulley portion of the aligning member slide motor M4. That is, driving of the aligning member slide motor M4 is transmitted to the aligning member 519 via the first slide drive transmission belt 524, the slide drive transmission pulley 526, the second slide drive transmission belt 525, and the slide member 521, so that the aligning member 519 is moved front and back while being guided by the first aligning supporting shaft 520. The slide drive transmission pulley 526 is supported by a pulley supporting shaft 527 and the pulley supporting shaft 527 is swaged and fixed to a pulley supporting plate 528. Both ends of the first aligning supporting shaft 520 and the second aligning supporting shaft 522 are connected with the pulley supporting plate 528 with E rings. The aligning member 519, the pulley supporting plate 528, and the like are unitized and attached to an upper stay 529. The aligning member slide motor M4 is attached to the upper stay 529 together with a slide motor supporting plate 530. Further, the aligning member 519, the pulley supporting plate 528, and the like which are unitized, the aligning member slide motor M5, and the like are arranged at the back side as well and attached to the upper stay 529 similarly to the front side. The front aligning member HP sensor S6 which detects the position of the aligning member 519 at the front side is attached to the upper stay 529 together with an aligning position detecting supporting plate 531. Similarly, the back aligning member HP sensor S7 is attached to the upper stay 529 together with the aligning position detecting supporting plate 531. The aligning members 519 of the front side and the back side are arranged as a pair, and slid in the direction intersecting with the sheet discharge direction to align a sheet.

Figure 8A:
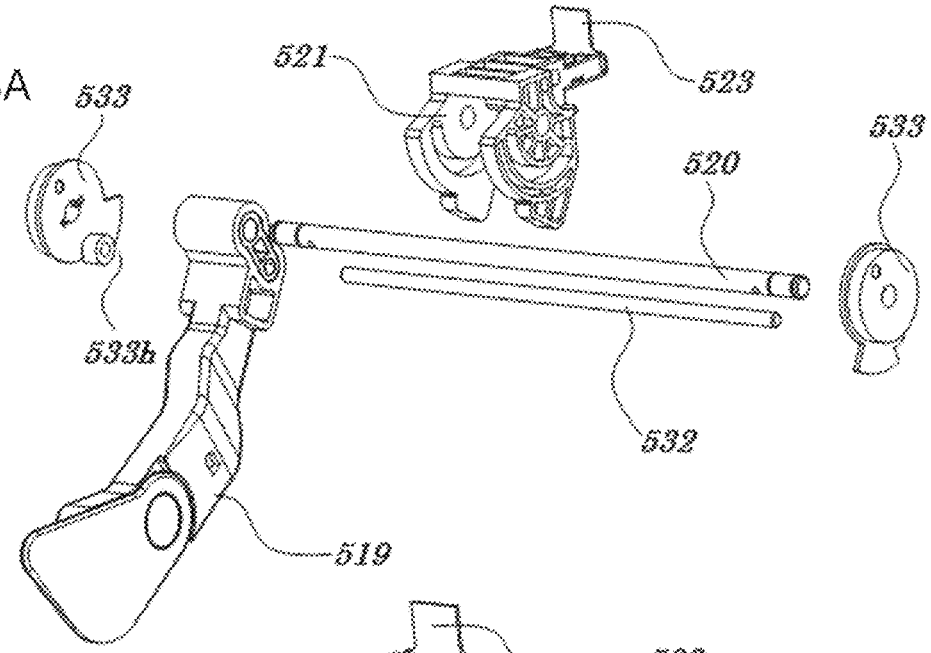
FIGS. 8A to 8C are perspective views illustrating lifting-lowering operation of the aligning member.
Figure 8B:
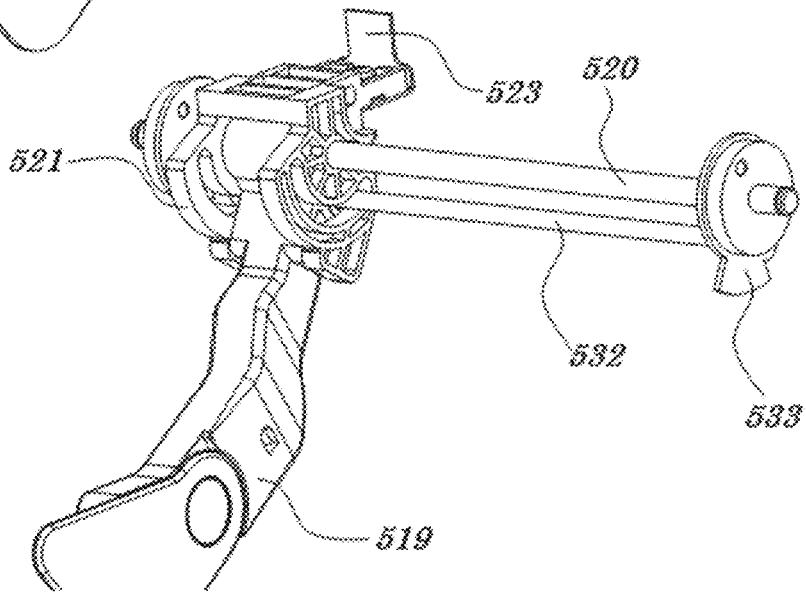
Figure 8C:
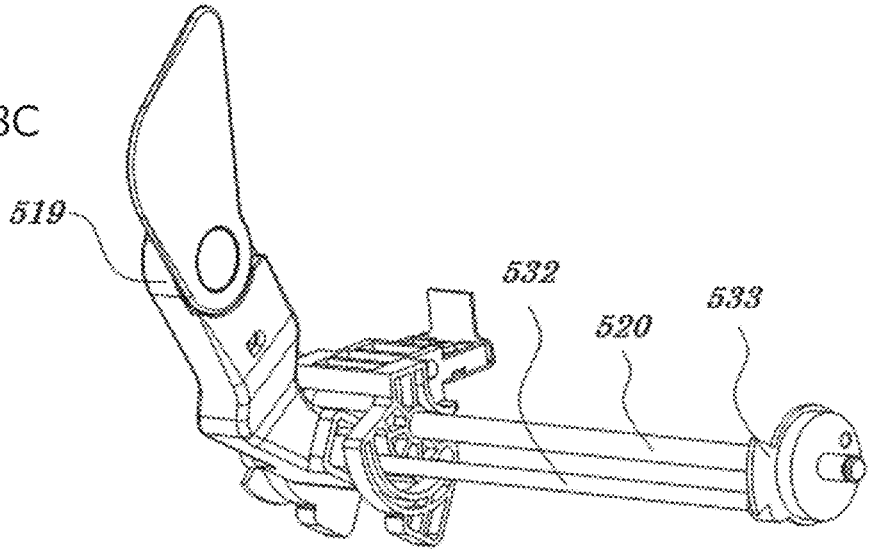

Subsequently, lifting-lowering operation of the aligning member 519 and members of the lifting-lowering unit will be described based on FIGS. 8A to 8C and FIGS. 9A to 9C. As described above, the aligning member 519 is supported by the first aligning supporting shaft 520, and further as illustrated in FIGS. 8A to 8C, the aligning member 519 is engaged with a third aligning supporting shaft 532 as a rotation stopper. The third aligning supporting shaft 532 is supported with both ends thereof fitted to a hole portion 533*h* of an aligning member lifting-lowering pulley 533. The aligning member lifting-lowering pulley 533 is supported with the first aligning supporting shaft 520 similarly to the aligning member 519. Since the first aligning supporting shaft 520, an aligning member lifting-lowering pulley 533-1, and an aligning member lifting-lowering pulley 533-2 are engaged with a parallel pin, rotation of the aligning member lifting-lowering pulley 533-1 and rotation of the aligning member lifting-lowering pulley 533-2 are synchronized. When the aligning member lifting-lowering pulleys 533-1, 533-2 rotate, the third aligning supporting shaft 532 rotates about the first aligning supporting shaft 520, and the aligning member 519 engaged thereto rotates as well to be lifted or lowered (FIG. 8C).

Figure 9A:
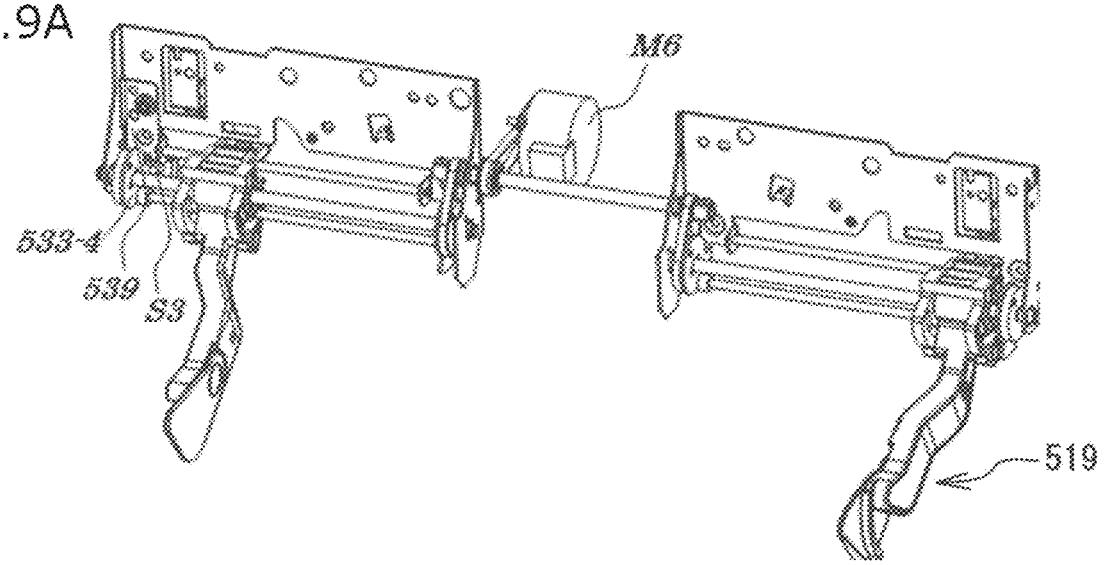
FIGS. 9A to 9C are perspective views illustrating a driving portion which drives the lifting-lowering operation of the aligning member.
Figure 9B:
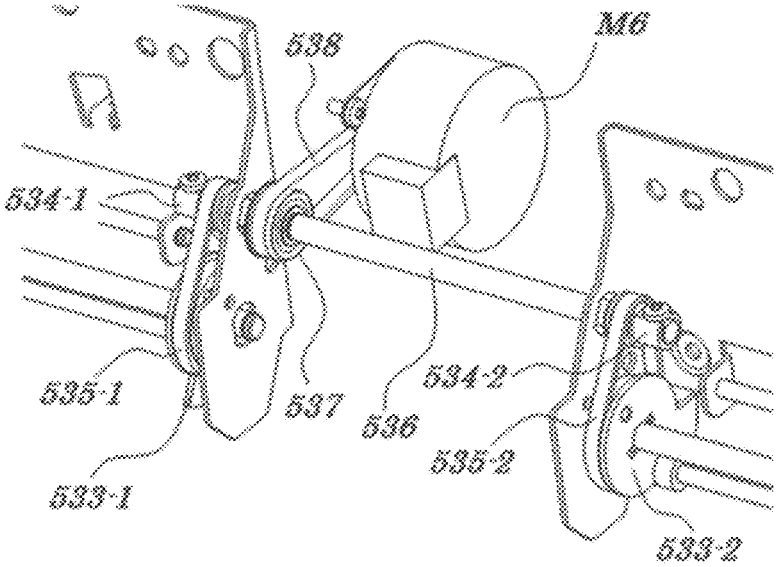
Figure 9C:
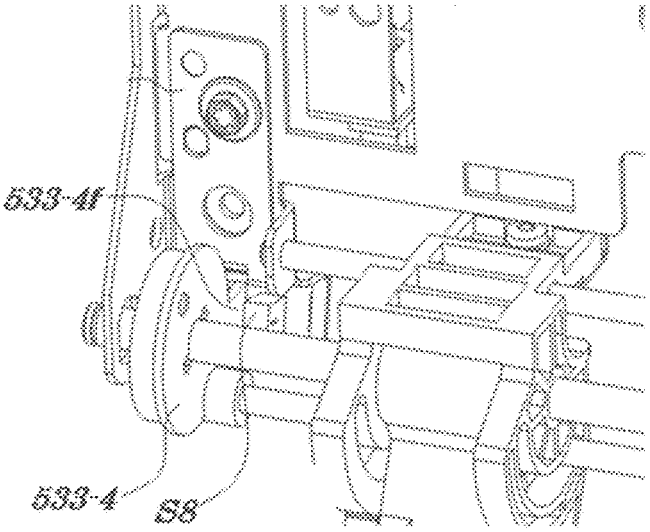

As illustrated in FIGS. 9A to 9C, rotary drive of a second lifting-lowering pulley 534-1 is transmitted to the aligning member lifting-lowering pulley 533-1 via a drive transmission belt 535-1. Since the second lifting-lowering pulleys 534-1, 534-2 are attached to a lifting-lowering transmission shaft 536 with D cut at both front and back, rotation of the lifting-lowering transmission shaft 536 and rotation of the second lifting-lowering pulleys 534-1, 534-2 are synchronized. Further, since a third lifting-lowering pulley 537 attached to a center part of the lifting-lowering transmission shaft 536 is engaged with a parallel pin as well, rotation of the third lifting-lowering pulley 537 and rotation of the lifting-lowering transmission shaft 536 are synchronized as well. That is, rotation of the second lifting-lowering pulley 534, rotation of the lifting-lowering transmission shaft 536, and rotation of the third lifting-lowering pulley 537 are synchronized. Driving of the aligning member lifting-lowering motor M6 is transmitted to the third lifting-lowering pulley 537 via a drive transmission belt 538, and further transmitted to the aligning member 519 via the lifting-lowering transmission shaft 536, the second lifting-lowering pulley 534, a drive transmission belt 535, the aligning member lifting-lowering pulley 533, and the third aligning supporting shaft 532. Thus, driving of the aligning member lifting-lowering motor M6 is transmitted to the aligning member 519 and the lifting-lowering operation of the aligning member 519 is performed. The second lifting-lowering pulley 534-1 transmits driving to the aligning member lifting-lowering pulley 533-1 at the back side and the second lifting-lowering pulley 534-2 transmits driving to the aligning member lifting-lowering pulley 533-2 at the front side. Thus, driving is transmitted to the aligning members 519 at both of the front side and back side for lifting and lowering. When the aligning member lifting-lowering pulley 533-1 at the back side is rotated, an aligning member lifting-lowering pulley 533-4 at the backmost is rotated as well. At this time, a flag portion 533-4*f* of the aligning member lifting-lowering pulley 533-4 turns on and off the aligning member lifting-lowering HP sensor S8 which detects a lifting-lowering position of the aligning member 519, so that the lifting-lowering position of the aligning member 519 is detected and controlled. Thus, driving of the aligning member lifting-lowering motor M6 is transmitted to the aligning members 519 at both of the front side and back side for lifting and lowering, and rotation and positions of the aligning members 519 of the front side and back side are controlled while lifting-lowering (rotation) thereof are synchronized.

According to the above operation, for sheets larger than a predetermined size in the width direction intersecting with the sheet discharging direction of the discharge roller pair 510, sheets are stacked onto the first and second stack trays 515, 516 while being aligned in the direction intersecting with the sheet discharging direction by the aligning member 519, and after a predetermined number, which is specified by a user, of sheets are stacked, the aligning member 519 is lifted or lowered to retreat from the aligning position. At this time, in a case that sorting is to be performed on the first and second stack trays 515, 516, stacking onto the first and second stack trays 515, 516 is performed in a state that sheets are moved by the shift unit 400 in a direction intersecting with the conveyance direction, and then, aligning operation for a first set is performed. Then, after discharging of the first set is completed, the moving direction of the shift unit 400 is changed. Then, to move the aligning member 519 to the aligning position in the width direction for a second set in which a predetermined amount has been sorted, the aligning member 519 is once retreated from the aligning position in the height direction and lowered to the aligning position in the height direction again after being moved to the aligning position in the width direction. Details of the operation will be described later. By repeating the above operation, a set number of sheets set by a user are stacked onto the first and second stack trays 515, 516.

Figure 10A:
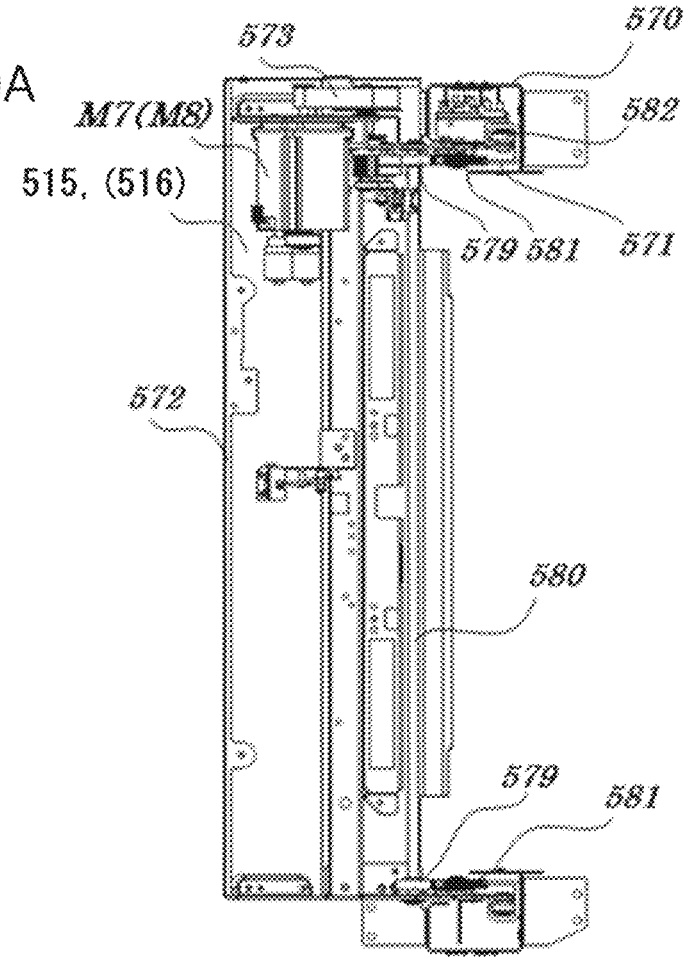
FIGS. 10A and 10B are explanatory views illustrating a lifting-lowering mechanism of a stack tray.
Figure 10B:
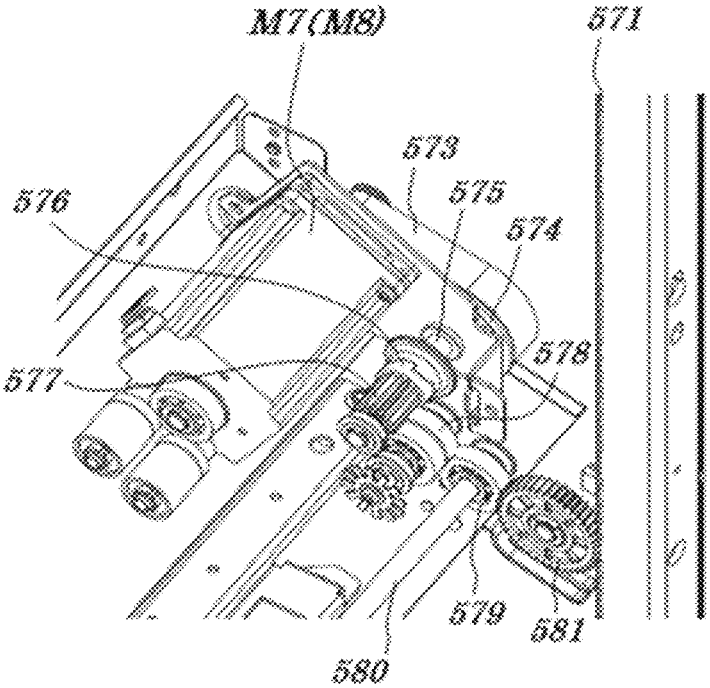

Subsequently, lifting-lowering operation of the first stack tray 515 and the second stack tray 516 will be described based on FIGS. 10A and 10B. The first and second stack trays 515, 516 are selectively used in accordance with situations, and are selectable by a user in accordance with copy output, printer output, sample output, interrupt output, output at the time of stack tray overflow, function sorting output, output at the time of job mixing, and the like. The first and second stack trays 515, 516 have a first stack tray lifting-lowering motor M7 and a second stack tray lifting-lowering motor M8, respectively, enabling lifting and lowering in the vertical direction independently, and are attached to a rack 571 attached to a frame 570 of the sheet stacking apparatus 500 in the vertical direction. Here, since the first and second stack trays 515, 516 have the same configuration, the first stack tray 515 will be described in the present embodiment and description of the second stack tray 516 will be omitted. As illustrated in FIGS. 10A and 10B, the first stack tray 515 is configured to have a first stack tray lifting-lowering motor M7 being a stepping motor attached to a tray base plate 572 and a pulley press fit onto the first stack tray lifting-lowering motor M7 transmits driving to a pulley 574 via a timing belt 573. A shaft 575 connected to the pulley 574 with a parallel pin transmits driving to a ratchet 576 connected thereto with the parallel pin as well, the ratchet 576 being urged to an idler gear 577 with an unillustrated spring. The idler gear 577 transmits driving to a gear 578 connected thereto, and the gear 578 transmits driving to a gear 579 connected thereto. Another gear 579 is attached thereto via a shaft 580 for driving the first stack tray 515 from both the front side and the back side, and these two gears 579 are connected to the rack 571 via a gear 581. The first stack tray 515 is fixed owing to that two rollers 582 arranged at one side are settled in the rack 571 also functioning as a roller receiver. At the first stack tray 515, the first stack tray lifting-lowering motor M7, the idler gear 577, the base plate 572 supporting the above, an unillustrated sheet supporting plate attached onto the base plate 572, and the like integrally configure a tray unit. Thus, owing to that driving of the first and second stack tray lifting-lowering motors M7, M8 is transmitted, the first and second stack trays 515, 516 are configured to be capable of being lifted and lowered in the arrowed Z direction in FIG. 3.

Figure 12A:
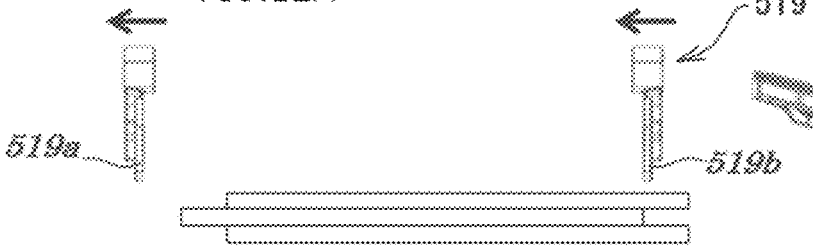
FIGS. 12A to 12F are explanatory views of the switching operation of the aligning members.
Figure 12B:
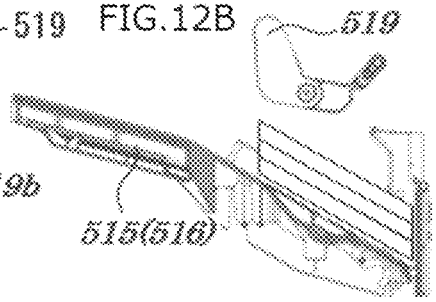
Figure 12C:
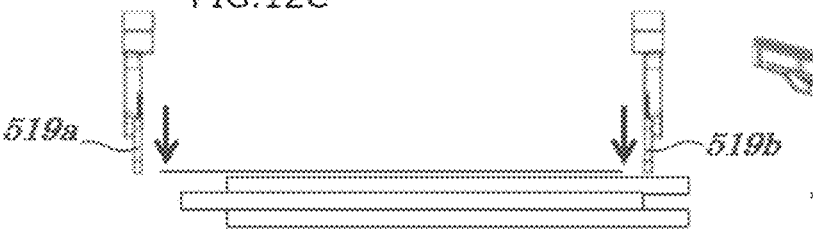
Figure 12D:
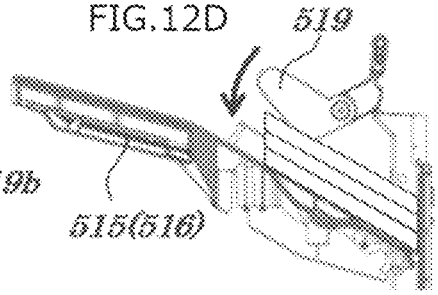
Figure 12E:
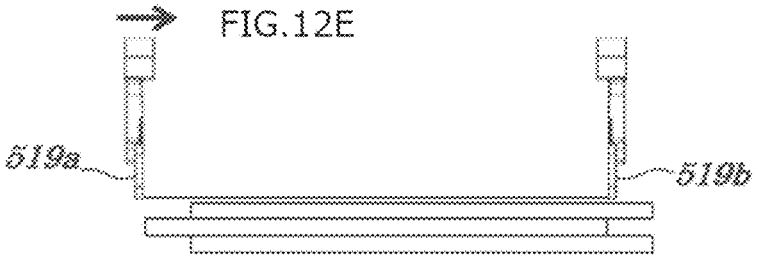
Figure 12F:
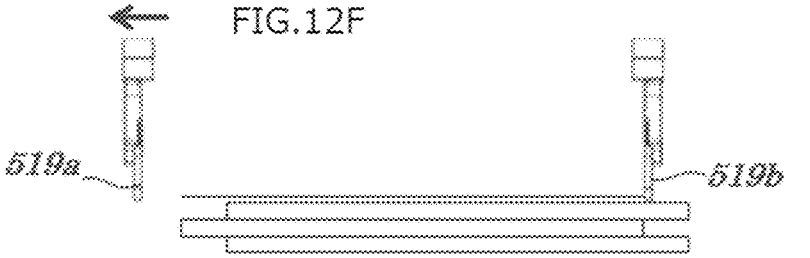
Figure 13:
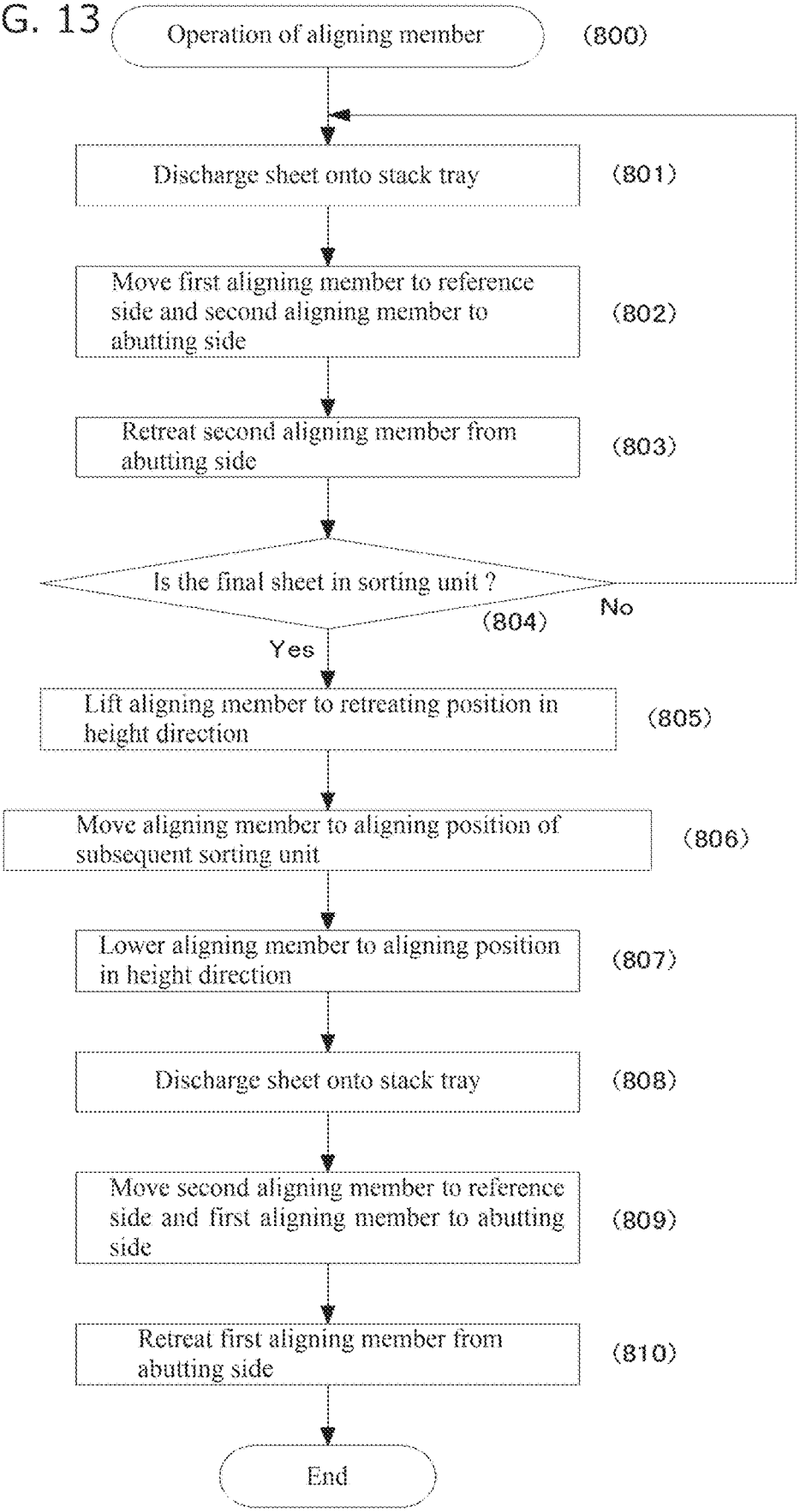
FIG. 13 is a flowchart of the switching operation of the aligning members.

Next, operation (800) of the aligning members 519 at the time of performing sorting processing will be described based on FIGS. 11 to 13. Here, since the aligning members 519 included in the first stack tray 515 and the second stack tray 516 have the same configuration and control, in the following embodiments, the first stack tray 515 and the second stack tray 516 are simply referred to as a stack tray 515 and the first sheet surface detecting sensor S1 is referred to as a sheet surface detecting sensor S1.

Figure 11A:
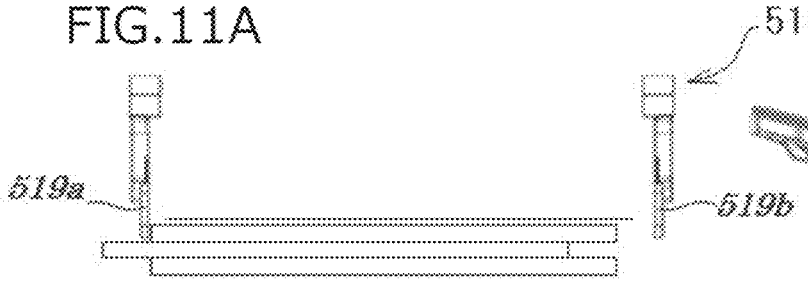
FIGS. 11A to 11F are explanatory views of switching operation of the aligning members.
Figure 11B:
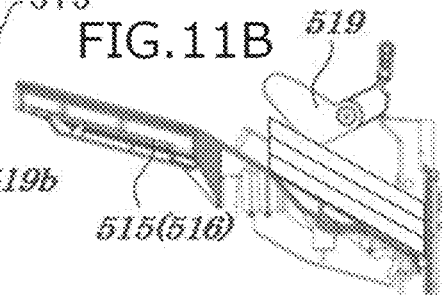
Figure 11C:
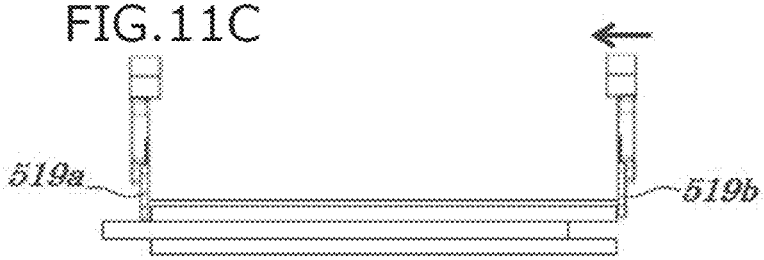
Figure 11D:
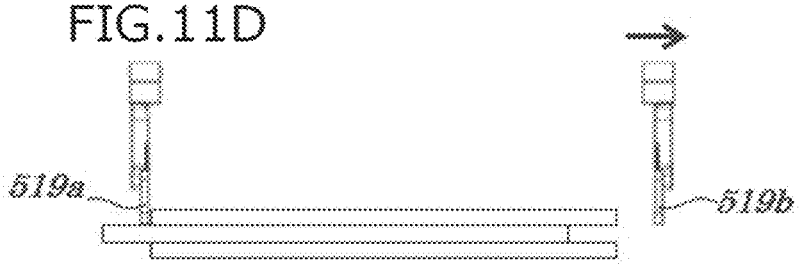
Figure 11E:
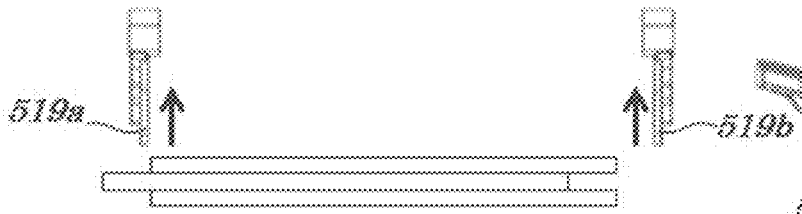
Figure 11F:
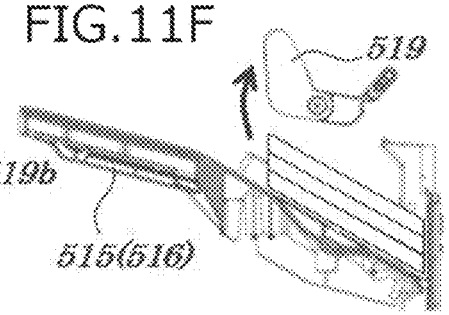

As illustrated in FIGS. 11A and 11B, when control of the sheet sorting processing is started, a pair of the aligning members 519 wait at a height position above a predetermined aligning position. A second aligning member 519*b* waits at a position away by a predetermined distance in the width direction from a position where a sheet is discharged and a first aligning member 519*a* being a reference side waits at an aligning position of stacked sheets. As illustrated in FIG. 11C, when a sheet is stacked onto the stack tray 515, the second aligning member 519*b* moves to an abutting side in the width direction and aligns the sheet toward the aligning position (FIG. 13 (801, 802)). Thus, when alignment of preceding sheets in a single sorting unit is completed, as illustrated in FIG. 11D, the second aligning member 519*b* moves in the width direction from the abutting side and retreats. When alignment of a final sheet in the single sorting unit is completed, as illustrated in FIGS. 11E and 11F, the pair of aligning members 519 are lifted and retreats to a height position above the aligning position (FIG. 13 (803 to 805)). When preceding sorting processing is thus completed and a sheet of a subsequent sorting unit is conveyed, as illustrated in FIG. 12A, the pair of aligning members 519 move parallel in the width direction by a predetermined amount and waits at a height position above the aligning position where a subsequent sheet is to be aligned. Then, as illustrated in FIGS. 12C and 12D, the pair of aligning members 519 are lowered to the aligning position (FIG. 12D) from the retreating position (FIG. 12B) in the height direction, and a subsequent sheet is discharged (FIG. 13 (806 to 808)). Then, as illustrated in FIG. 12E, the first aligning member 519*a* moves in the width direction so that a sheets is abutted to the second aligning member 519*b* and aligned, and when alignment is completed, the first aligning member 519*a* retreats in the width direction and waits for reception of a subsequent sheet.

As described above, a sheet on which sort processing is to be performed are to abut to one of the first aligning member 519*a* and the second aligning member 519*b* with the other thereof moving toward the one thereof. Switching of this operation is performed by once retreating the aligning members 519 to a retreating position in the height direction, moving the aligning members 519 to the aligning position of a subsequent sheet in the width direction, and lowering the aligning members 519 to an aligning position in the height direction. According to the above, when the aligning members 519 move to the aligning position in the width direction, contact with stacked sheets does not occur, so that displacement of sheets sorted and aligned does not occur.

Although there is no problem for the sheet aligning operation of the sorting processing described above if sheets stacked on the stack tray 515 are flat, there may be a case that a part of sheets having an image formed thereon at the image forming apparatus 110 curls depending on a type of sheets used and a usage environment. In the present invention, assuming such a case, a plurality of controllers for smoothly performing sorting processing and discharging sheets are included. FIGS. 14A to 14F and FIG. 15 illustrate the sorting and aligning operation of a first embodiment and control flow thereof in a case that a part of sheets stacked on the stack tray 515 is curled.

Figure 14A:
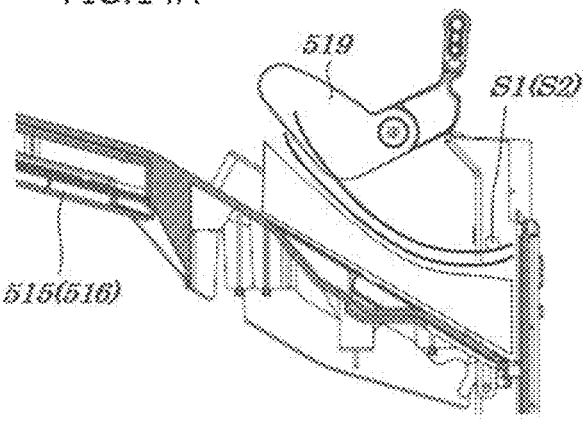
FIGS. 14A to 14F are explanatory views of switching operation of aligning members in a first embodiment.
Figure 14B:
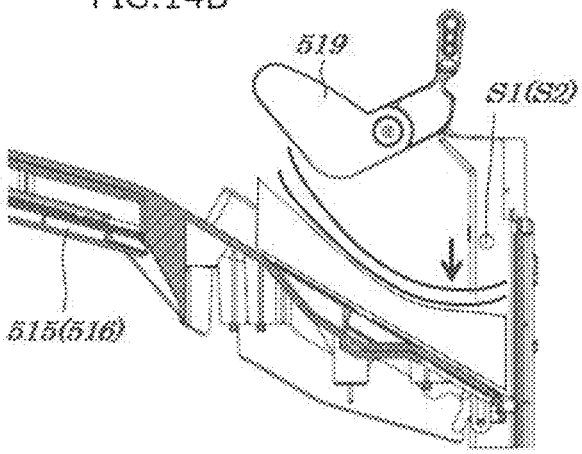
Figure 14C:
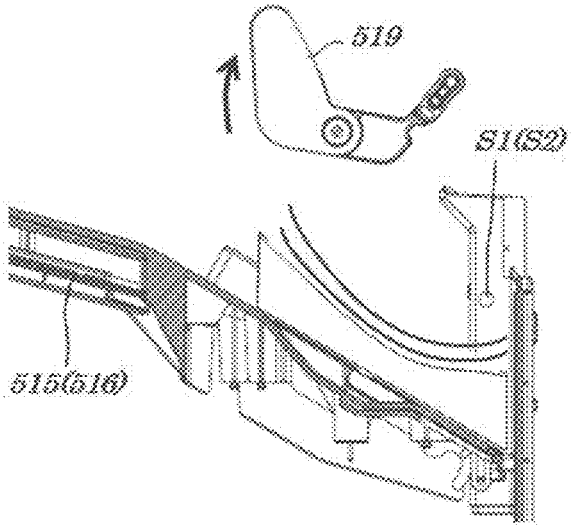
Figure 14D:
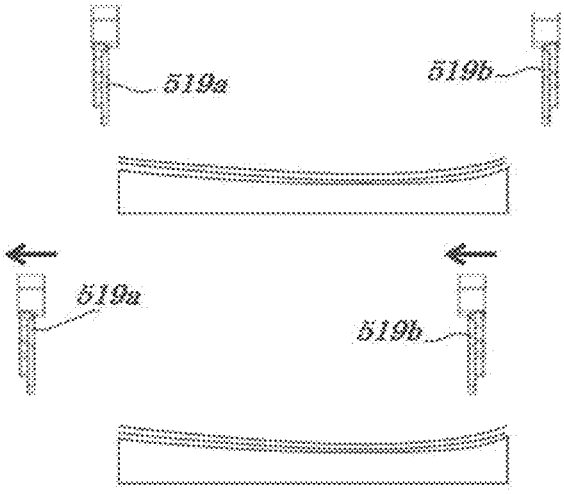
Figure 14E:
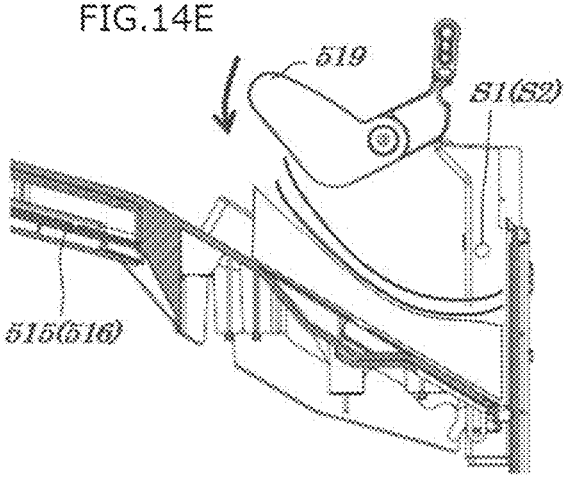
Figure 14F:
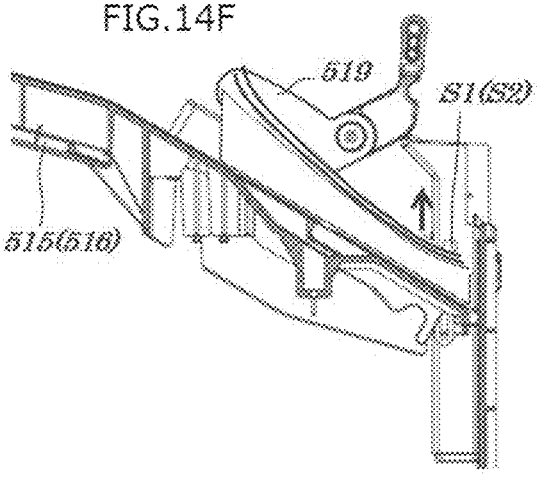
Figure 15:
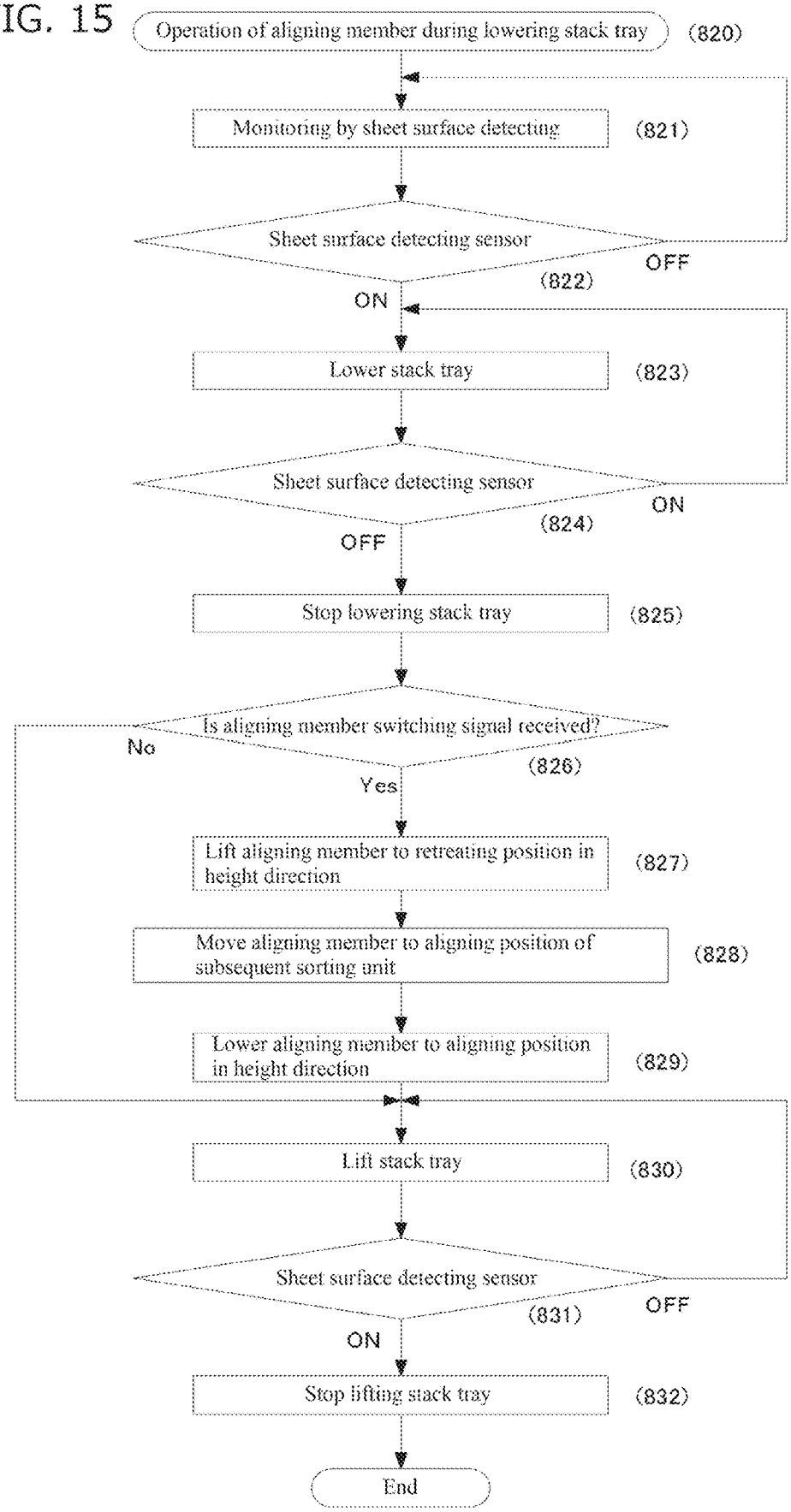
FIG. 15 is a flowchart of the switching operation the aligning members in the first embodiment.

As illustrated in FIG. 14A, in a case that a part of sheets stacked on the stack tray 515 is curled upward, the sheet surface detecting sensor S1 detects a curled sheet surface at the upstream side, determines that the sheet surface is high, and lowers the stack tray 515 as illustrated in FIG. 14B (FIG. 15 (821 to 823)). Then, the stack tray 515 is stopped when the stack tray 515 is lowered until an optical axis of the sheet surface detecting sensor S1 appears (FIG. 15 (824, 825)). Conventionally, the stack tray 515 is lifted in a case that a signal for switching an aligning reference side of the aligning members 519 is input. However, in the present embodiment, the stack tray 515 is not lifted and, as illustrated in FIG. 14C, the aligning members 519 are lifted to a predetermined retreating position in the height direction (FIG. 15 (826, 827)). Then, as illustrated in FIG. 14D, the aligning members 519 are moved to the aligning position of a subsequent sheet in the width direction and after the movement of the aligning members 519 in the width direction is completed, as illustrated in FIG. 14E, the aligning members 519 are lowered to the aligning position in the height direction (FIG. 15 (828, 829)). Then, as illustrated in FIG. 14F, when the optical axis of the sheet surface detecting sensor S1 is blocked after starting lifting of the stack tray 515, the lifting of the stack tray 515 is stopped (FIG. 15 (830 to 832)). In a case that the switching signal of the aligning members 519 is not input when the optical axis of the sheet surface detecting sensor S1 appears, the stack tray 515 is lifted as conventionally. In the sorting processing described above, since the switching signal for the aligning members 519 is received at any time, there may be a case that timing for lifting the stack tray 515 cannot be ensured when a plurality of sets are sorted with one sheet as a unit. Accordingly, in a case that a plurality of sets are sorted with one sheet as a unit, the stack tray 515 is controlled to be lifted. That is, in the present invention, as illustrated in FIGS. 14A to 14F, the lifting-lowering operation of the stack tray 515 with the stack tray lifting-lowering device is controlled to be stopped while the aligning members 519 are moved in a case that the number of sheets to be aligned at the predetermined aligning position in a single sorting unit is equal to or larger than a predetermined number, for example equal to or larger than two. On the other hand, in a case that the number of sheets to be aligned in a single sorting unit is smaller than the predetermined number, such as one, the lifting-lowering operation of the stack tray 515 with the stack tray lifting-lowering device is not stopped, so that speed-up of the processing is achieved. The number of sheets for control of the lifting-lowering operation of the stack tray 515 can be appropriately set in accordance with a type, a thickness, and the like of the sheets.

Here, in the flow of the present embodiment, the aligning members 519 are moved in the width direction (FIG. 15 (828)), the aligning members 519 are lowered to the aligning position in the height direction, and then, the stack tray 515 is lifted. However, similar effects can be obtained by moving the aligning members 519 in the width direction, lifting the stack tray 515, and then lowering the aligning members 519 to the aligning position, or lifting the stack tray 515 and lowering the aligning members 519 to the aligning position at the same time.

Figure 16A:
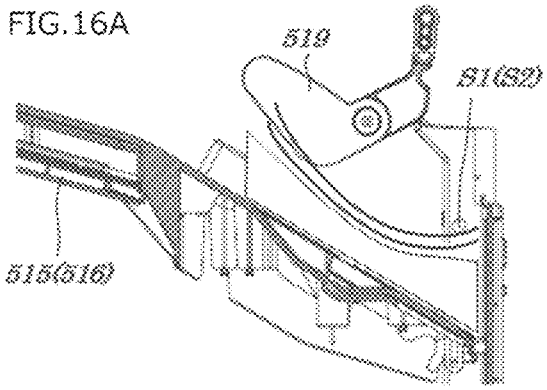
FIGS. 16A to 16G are explanatory views of the switching operation of the aligning members in the first embodiment.
Figure 16B:
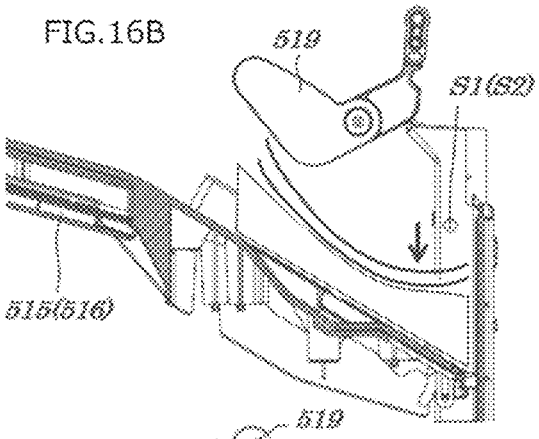
Figure 16C:
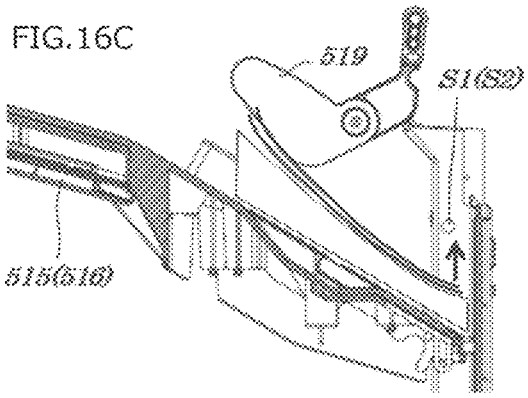
Figure 16D:
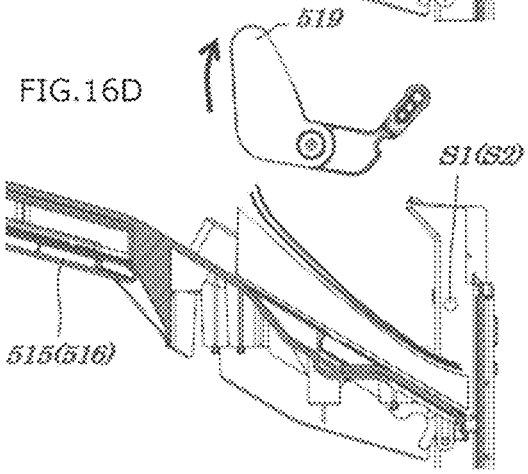
Figure 16E:
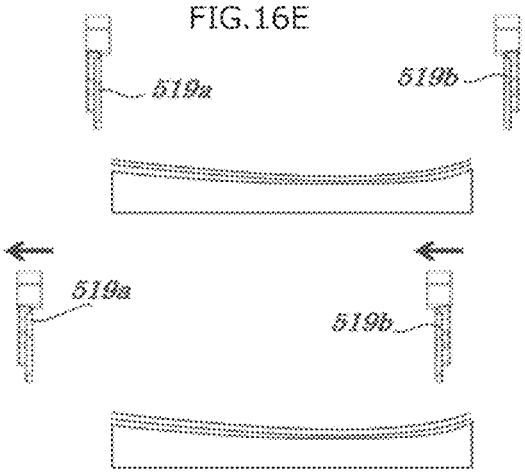
Figure 16F:
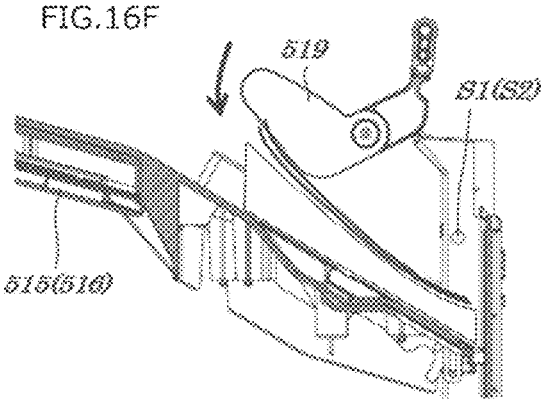
Figure 16G:
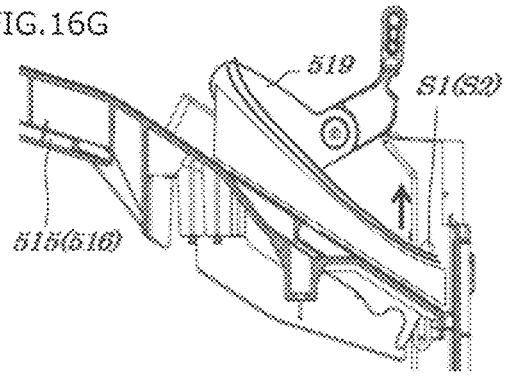
Figure 17:
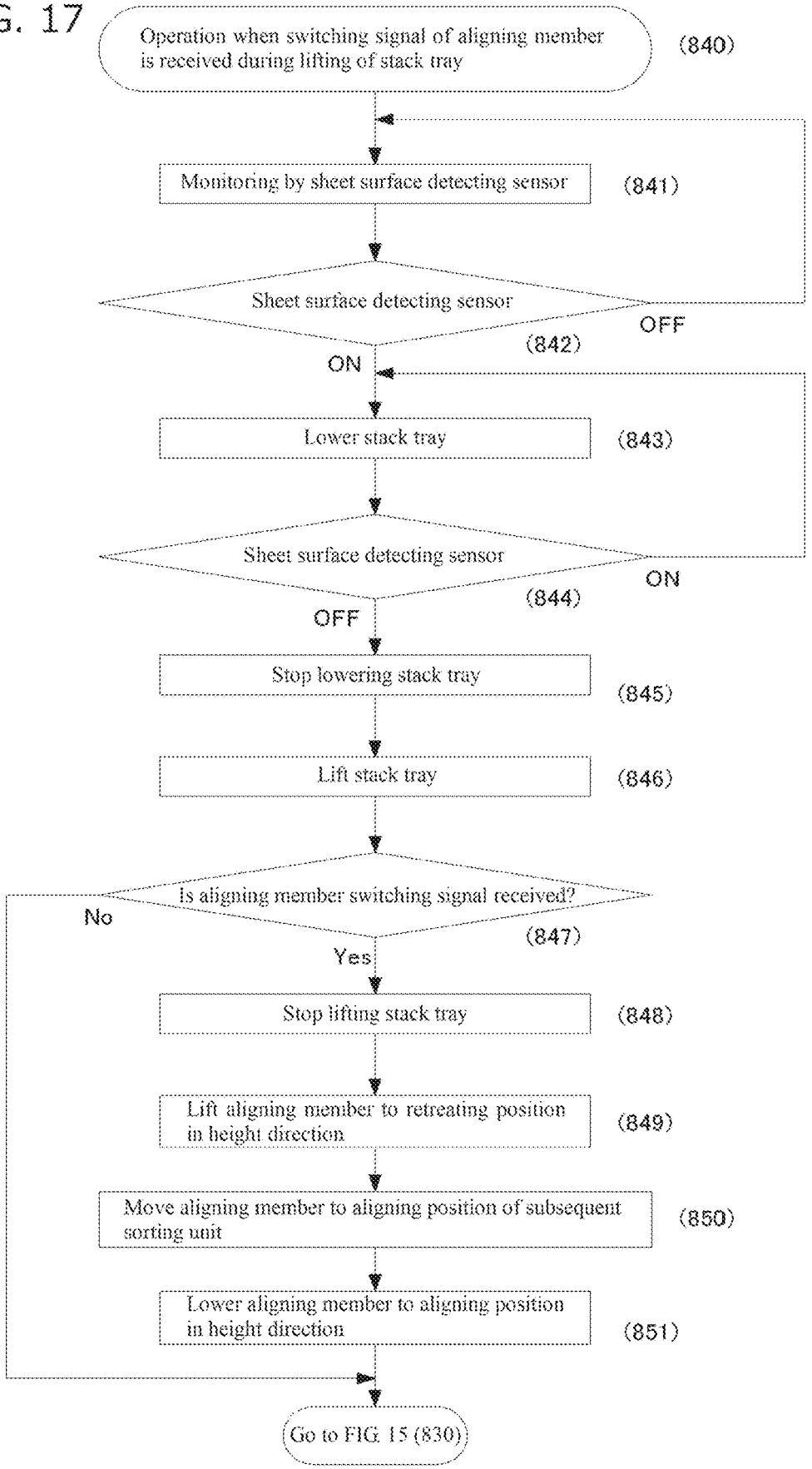
FIG. 17 is a flowchart of the switching operation the aligning members in the first embodiment.

FIGS. 16A to 16G and FIG. 17 illustrate operation in a case that the switching signal of the aligning members 519 is received during lifting of the stack tray 515 (FIG. 17 (840)). Similarly to the case described above, when sheets curled upward are stacked, the stack tray 515 is lowered until the optical axis of the sheet surface detecting sensor S1 appears (FIG. 17 (841 to 845)), as in the first embodiment illustrated in FIGS. 16A and 16B. When the optical axis of the sheet surface detecting sensor S1 appears, the stack tray 515 is lifted as illustrated in FIG. 16C, and the switching signal of the reference side of the aligning members 519 is received during the lifting, lifting of the stack tray 515 is stopped even when the optical axis of the sheet surface detecting sensor S1 is not blocked as illustrated in FIG. 16D, and the aligning members 519 are lifted to the retreating position in the height direction (FIG. 17 (846 to 849)). Then, as illustrated in FIG. 16E, the aligning members 519 are moved to the aligning position of a subsequent sheet in the width direction and the aligning members 519 are controlled to be lowered to the aligning position in the height direction (FIG. 17 (850, 851)). When the optical axis of the sheet surface detecting sensor S1 is blocked while lifting the stack tray 515 again, the lifting of the stack tray 515 is stopped.

Figure 18A:
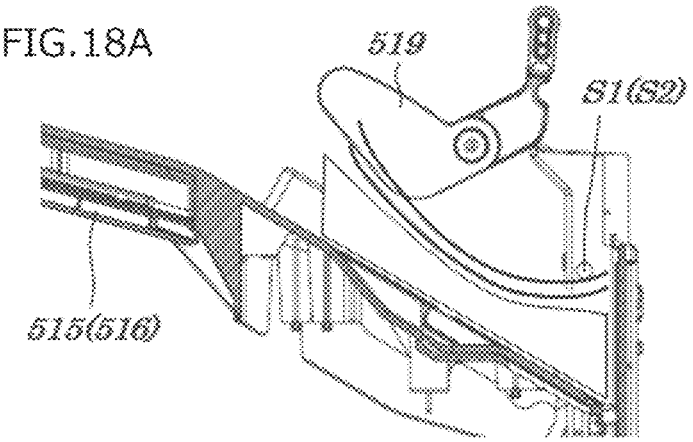
FIGS. 18A to 18C are explanatory views of switching operation of aligning members in a second embodiment.
Figure 18B:
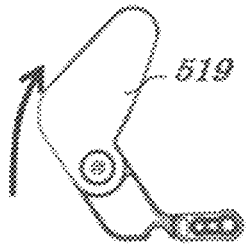
Figure 18B:
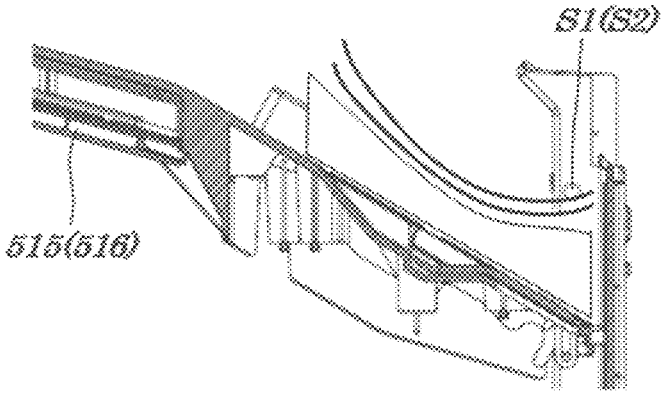
Figure 18C:
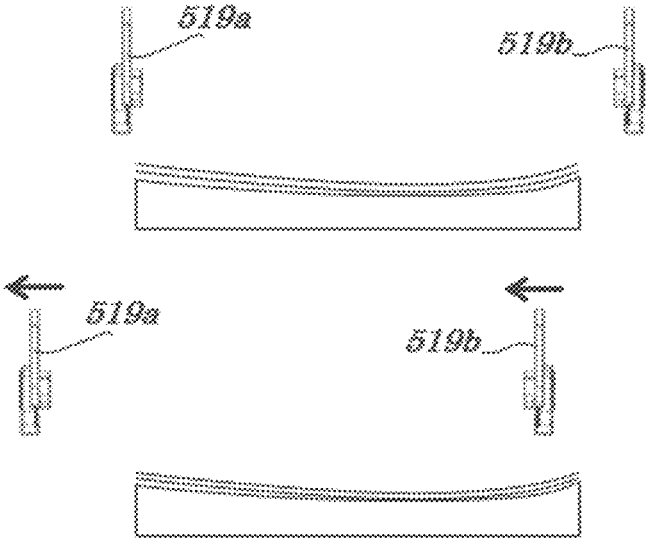
Figure 19A:
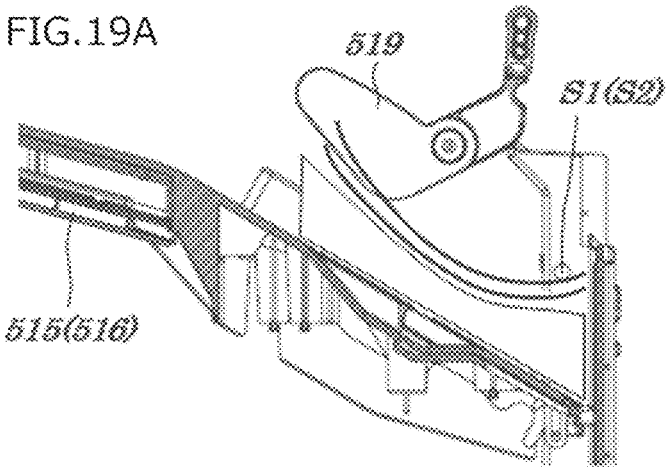
FIGS. 19A to 19C are explanatory views of switching operation of aligning members in a third embodiment.
Figure 19B:
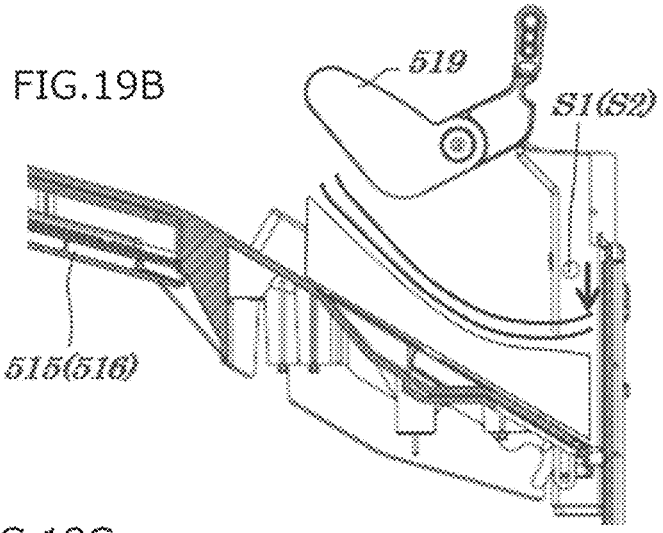
Figure 19C:
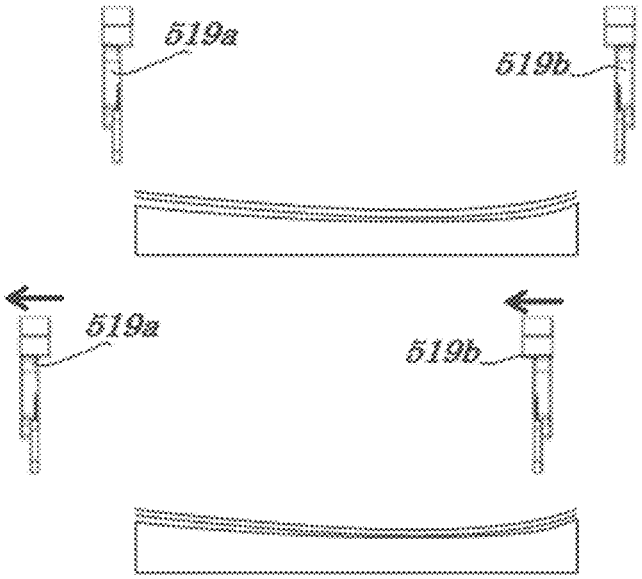
Figure 20A:
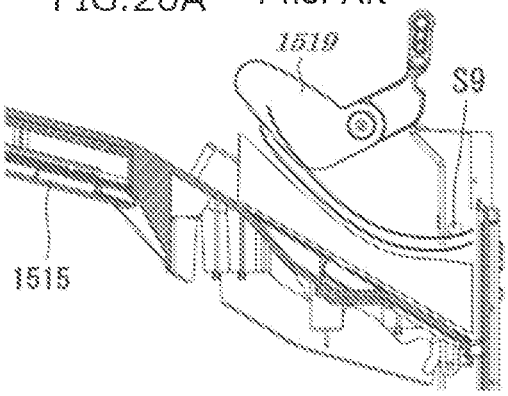
FIG.20A Prior Art
FIGS. 20A to 20D are explanatory views illustrating a series of aligning operation of sheets in a conventional sheet stacking apparatus.
Figure 20B:
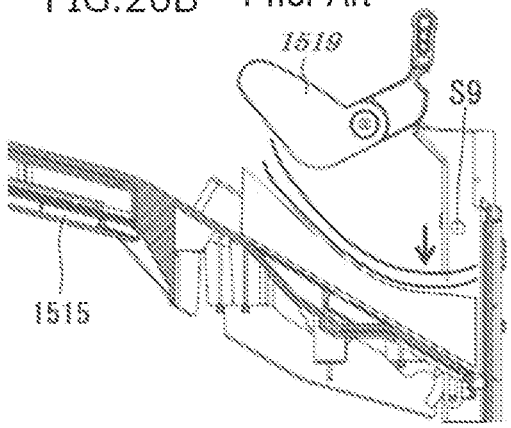
FIG.20B Prior Art
Figure 20C:
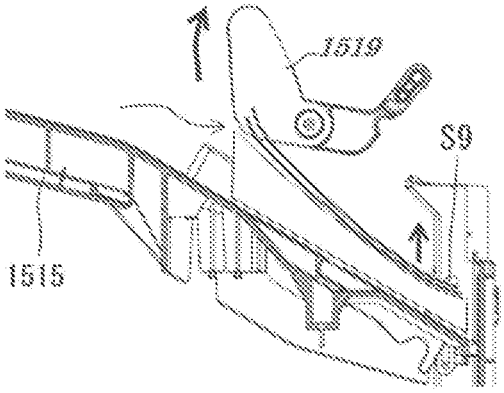
FIG.20C Prior Art
Figure 20D:
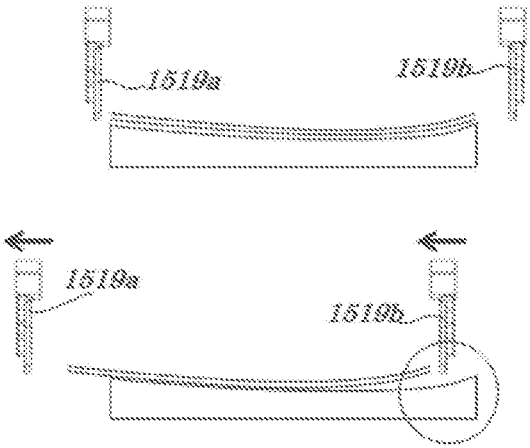
FIG.20D Prior Art

FIGS. 18A to 18C and FIGS. 19A to 19C illustrate the sorting and aligning operation of a second embodiment and control flow thereof. As illustrated in FIGS. 18A to 18C, when sheets are stacked onto the stack tray 515 and the switching signal of the reference side of the aligning members 519 for sorting of the sheets is received, the aligning members 519 are lifted from an aligning position in the height direction illustrated in FIG. 18A to a retreating position in the height direction illustrated in FIG. 18B. At this time, the aligning members 519 are retreated to a position to be certainly away from a curled sheet surface. In this state, as illustrated in FIG. 18C, the aligning members 519 are controlled to be moved to an aligning position of subsequent sheets in the width direction. Since time required for lifting and lowering the aligning members 519 increases, as illustrated in FIG. 2, a signal to delay sheet discharging is transmitted to the printer controller 635 from the sheet stacking apparatus controller 636. Alternatively, pulses to be output from the stack tray lifting-lowering motor M7 illustrated in FIG. 10 may be stored in the sheet stacking apparatus controller 636, the output pulse number of the stack tray lifting-lowering motor M7 during lowering of the stack tray 515 may be counted, and control may be performed to change the retreating position in the height direction of the aligning members 519 in accordance with the pulse number. For example, when the output pulse number during lowering of the stack tray 515 is smaller than a predetermined pulse number, the retreating amount of the aligning members 519 in the height direction is decreased, and when the output pulse number is larger than the predetermined pulse number, it is determined that an upward curl exists owing to that the lowering amount of the stack tray 515 is large and the retreating amount of the aligning members 519 is increased. According to such a variable control, the number of times to cause the apparatus main body 100 to delay sheet discharging can be minimized. Here, similar effects can be obtained by controlling to move the aligning members 519 to the aligning position of a subsequent sheet in the width direction as illustrated in FIG. 19C after lowering the stack tray 515 from the position of FIG. 19A to the position of FIG. 19B by a predetermined amount when receiving the switching signal of the reference side of the aligning members 519, as illustrated in FIG. 19.

Further, as a controller of a third embodiment, lifting and lowering of the stack tray 515 may be repeated by continuously monitoring sheet surface height of sheets on the stack tray 515 by the sheet surface detecting sensor S1 while sheets are discharged to the stack tray 515. In the present embodiment, in a case that the sorting processing of sheets is performed on the stack tray 515, detection of the sheet surface by the sheet surface detecting sensor S1 is controlled to be stopped after a predetermined time passes from completion of moving the sheets by the shift unit 400. Change of the moving direction by the shift unit 400 means change of the sorting direction and occurrence of switching of the reference side of the aligning members 519. Since monitoring of the sheet surface by the sheet surface detecting sensor S1 is not performed for the predetermined time, the lifting-lowering operation of the stack tray 515 is not performed at that time as well. Accordingly, similar effects can be obtained as controlling the stack tray lifting-lowering motors M7, M8 not to lift and lower the stack tray 515.

Here, as illustrated in FIG. 3, with a configuration in which the first stack tray 515 is arranged above and the second stack tray 516 is arranged below, since a conveyance path length differs, a time not to monitor with the second sheet surface detecting sensor S2 may be set longer than a time not to monitor with the first sheet surface detecting sensor S1 in consideration of the path length difference.

The invention claimed is:

1. A sheet stacking apparatus comprising:

a conveyance device configured to convey sheets in a predetermined sheet conveyance direction;

a stack tray on which sheets conveyed by the conveyance device are to be stacked;

a pair of aligning members configured to abut to the sheets stacked on the stack tray in a sheet width direction intersecting with the sheet conveyance direction and to align the sheets;

an aligning member lifting-lowering device configured to lift and lower the aligning members between an aligning position where the aligning members abut to and align the sheets and a retreating position where the aligning members are lifted from an upper surface of the sheets;

an aligning member moving device configured to move the aligning members in the sheet width direction;

a sheet surface detecting device configured to detect an uppermost surface position of the sheets stacked on the stack tray;

a stack tray lifting-lowering device configured to lift and lower the stack tray based on a detection result of the sheet surface detecting device; and a controller configured to control the aligning member lifting-lowering device, the aligning member moving device, and the stack tray lifting-lowering device, wherein in a case that a subsequent sheet subsequent to the sheets is aligned at another aligning position different from the aligning position of the sheets in the sheet width direction, the controller lifts the aligning members to the retreating position with the aligning member lifting-lowering device after the sheets stacked on the stack tray are aligned at the aligning position, lowers the stack tray with the stack tray lifting-lowering device, and lifts the stack tray with the stack tray lifting-lowering device after movement of the aligning members to the another aligning position of the subsequent sheet with the aligning member moving device is completed.

2. The sheet stacking apparatus according to claim 1, wherein the controller stops lifting-lowering operation of the stack tray lifting-lowering device in a case that a number of sheets to be aligned at a predetermined aligning position is equal to or larger than a predetermined number.

3. The sheet stacking apparatus according to claim 1, wherein the controller starts lifting-lowering operation of the stack tray lifting-lowering device after the aligning members are lifted from the aligning position to the retreating position and are moved to the another aligning position of the subsequent sheet with the aligning member moving device.

4. The sheet stacking apparatus according to claim 1, wherein the controller stops lifting-lowering operation with the stack tray lifting-lowering device while the aligning members are moved to the retreating position with the aligning member lifting-lowering device, and starts the lifting-lowering operation with stack tray lifting-lowering device again after the aligning members are moved to the another aligning position of the subsequent sheet with the aligning member moving device.

5. The sheet stacking apparatus according to claim 1, wherein the controller varies a retreating amount of the pair of aligning members in a height direction in accordance with a lifting-lowering amount of the stack tray.

6. The sheet stacking apparatus according to claim 1, further comprising:

a shift device configured to move the sheets in the sheet width direction intersecting with the conveyance direction and arranged at a sheet conveyance path leading to the stack tray, wherein the shift device stops detection of the uppermost surface of the sheets with the sheet surface detecting device after a predetermined time elapses from completion of sheet movement with the shift device.

7. An image forming apparatus including the sheet stacking apparatus according to claim 1 arranged in an image forming apparatus main body in which an image is formed on the sheets.

8. The sheet stacking apparatus according to claim 1, wherein the sheet surface detecting device is a sensor having an optical axis configured to detect the uppermost surface position of the sheets stacked on the stack tray by blocking the optical axis, and in the case that the subsequent sheet subsequent to the sheets is aligned at the another aligning position different from the aligning position of the sheets in the sheet width direction, the controller lifts the aligning members to the retreating position with the aligning member lifting-lowering device after the sheets stacked on the stack tray are aligned at the aligning position, lowers the stack tray with the stack tray lifting-lowering device until the optical axis appears, and lifts the stack tray with the stack tray lifting-lowering device after movement of the aligning members to the another aligning position of the subsequent sheet with the aligning member moving device is completed.

* * * * *